US011798719B2

(12) United States Patent
Yoshidome et al.

(10) Patent No.: US 11,798,719 B2
(45) **Date of Patent: *Oct. 24, 2023**

(54) SOFT MAGNETIC METAL POWDER, DUST CORE, AND MAGNETIC COMPONENT

(71) Applicant: TDK CORPORATION, Tokyo (JP)

(72) Inventors: Kazuhiro Yoshidome, Tokyo (JP); Hiroyuki Matsumoto, Tokyo (JP); Kenji Horino, Tokyo (JP); Satoko Mori, Tokyo (JP); Takuma Nakano, Tokyo (JP); Seigo Tokoro, Tokyo (JP); Shota Otsuka, Tokyo (JP); Toru Ujiie, Tokyo (JP); Kentaro Mori, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/296,348

(22) Filed: Mar. 8, 2019

(65) Prior Publication Data

US 2019/0279801 A1 Sep. 12, 2019

(30) Foreign Application Priority Data

Mar. 9, 2018 (JP) ..... 2018-043645

(51) Int. Cl.
*H01F 1/24* (2006.01)
*H01F 1/38* (2006.01)
(Continued)

(52) U.S. Cl.
CPC ..... *H01F 1/24* (2013.01); *B22F 1/16* (2022.01); *H01F 1/26* (2013.01); *H01F 1/33* (2013.01);
(Continued)

(58) Field of Classification Search
CPC .... B22F 1/02; B22F 2301/35; B22F 2304/10; B22F 1/0059; B22F 1/0062;
(Continued)

(56) References Cited

U.S. PATENT DOCUMENTS 7,544,417 B2 * 6/2009 Maeda ..... B22F 1/0059 428/212
7,622,202 B2 * 11/2009 Maeda ..... B22F 1/02 428/405
(Continued)

FOREIGN PATENT DOCUMENTS

CN 102789863 A * 11/2012
JP 2007-194273 A 8/2007
(Continued)

OTHER PUBLICATIONS

Machine Translation of JP 2007194273 (Year: 2007).*
(Continued)

*Primary Examiner* — Mark Ruthkosky
*Assistant Examiner* — Rebecca L Grusby
(74) *Attorney, Agent, or Firm* — Oliff PLC

(57) ABSTRACT

A soft magnetic metal powder having soft magnetic metal particles, wherein a surface of the soft magnetic metal particle is covered by a coating part, the coating part has a first coating part, a second coating part, and a third coating part in this order from the surface of the soft magnetic metal particle towards outside, the first coating part includes oxides of Si as a main component, the second coating part includes oxides of Fe as a main component, and the third coating part includes a compound of at least one element selected from the group consisting of P, Si, Bi, and Zn.

10 Claims, 4 Drawing Sheets

(51) Int. Cl.

| | |
|---|---|
| ***H01F 1/33*** | (2006.01) |
| ***H01F 1/26*** | (2006.01) |
| ***H01F 3/08*** | (2006.01) |
| ***B22F 1/16*** | (2022.01) |
| ***H01F 27/255*** | (2006.01) |
| ***H01F 41/02*** | (2006.01) |
| ***H01F 1/153*** | (2006.01) |

(52) U.S. Cl.
CPC ..... *H01F 1/38* (2013.01); *H01F 3/08* (2013.01); *B22F 2301/35* (2013.01); *B22F 2304/10* (2013.01); *H01F 1/15308* (2013.01); *H01F 1/15333* (2013.01); *H01F 27/255* (2013.01); *H01F 41/0246* (2013.01)

(58) Field of Classification Search
CPC ..... B22F 2302/25; B22F 2302/256; B22F 2302/45; B22F 2302/01; B22F 2302/20; H01F 1/15308; H01F 1/15333; H01F 1/24; H01F 1/26; H01F 1/33; H01F 1/38; H01F 27/255; H01F 3/08; H01F 41/0246; H01F 1/1533; H01F 1/14733; H01F 1/1475; H01F 1/15383; H01F 1/20; H01F 1/36; H01F 17/04; C22C 38/02; C22C 38/06; C22C 38/08; C22C 38/105; C22C 38/32; C22C 38/34; C22C 45/02; C22C 2202/02
See application file for complete search history.

(56) References Cited

U.S. PATENT DOCUMENTS

2006/0216507 A1* 9/2006 Toyoda ..... H01F 1/26 428/402
2012/0082844 A1* 4/2012 Takahashi ..... H01F 1/33 428/336
2014/0138570 A1* 5/2014 Otsuka ..... H01F 1/24 252/62.55
2015/0104664 A1* 4/2015 Ikari ..... H01Q 1/364 428/546
2016/0071636 A1* 3/2016 Ohtsubo ..... C21D 1/26 148/307
2017/0209924 A1* 7/2017 Suetsuna ..... C22C 38/02
2018/0005739 A1* 1/2018 Orimo ..... C01B 33/12
2018/0374619 A1* 12/2018 Orimo ..... B22F 1/16
2019/0103207 A1* 4/2019 Sato ..... H01F 1/24

FOREIGN PATENT DOCUMENTS

JP 2007254768 A * 10/2007
JP 2010073967 A * 4/2010
JP 2011-032496 A 2/2011
JP 2013168648 A * 8/2013 ..... A61B 17/1617
JP 2015-132010 A 7/2015
JP 2016086124 A * 5/2016

OTHER PUBLICATIONS

Machine Translation of JP 2011032496 (Year: 2011).*
Machine Translation of JP 2015132010 (Year: 2015).*
Machine Translation of JP 2007254768 (Year: 2007).*
Machine Translation of JP 2016086124 (Year: 2016).*
Machine Translation of JP 2013-168648 via EPO (Year: 2013).*
Machine Translation via EPO of CN 102789863 (Year: 2012).*
Machine translation of JP 2010-073967 via EPO (Year: 2010).*

* cited by examiner

SOFT MAGNETIC METAL POWDER, DUST CORE, AND MAGNETIC COMPONENT

BACKGROUND OF THE INVENTION

The present invention relates to soft magnetic metal powder, a dust core, and a magnetic component.

As a magnetic component used in power circuits of various electronic equipments, a transformer, a choke coil, an inductor, and the like are known.

Such magnetic component is configured so that a coil (winding coil) as an electrical conductor is disposed around or inside a core exhibiting predetermined magnetic properties.

As a magnetic material used to the core provided to the magnetic component such as an inductor and the like, a soft magnetic metal material including iron (Fe) may be mentioned as an example. The core can be obtained for example by compress molding the soft magnetic metal powder including particles constituted by a soft magnetic metal including Fe.

In such dust core, in order to improve the magnetic properties, a proportion (a filling ratio) of magnetic ingredients is increased. However, the soft magnetic metal has a low insulation property, thus in case the soft magnetic metal particles contact against each other, when voltage is applied to the magnetic component, a large loss is caused by current flowing between the particles in contact (inter-particle eddy current). As a result, a core loss of the dust core becomes large.

Thus, in order to suppress such eddy current, an insulation coating is formed on the surface of the soft magnetic metal particle. For example, Japanese Patent Application Laid-Open No. 2015-132010 discloses that powder glass including oxides of phosphorus (P) is softened by mechanical friction and adhered on the surface of Fe-based amorphous alloy powder to form an insulation coating layer.

[Patent Document 1] JP Patent Application Laid Open No. 2015-132010

BRIEF SUMMARY OF THE INVENTION

Patent Document 1 discloses a dust core which is formed by mixing and compress molding a resin and Fe-based amorphous alloy powder which is formed with an insulation coating layer. According to the present inventors, in case of heat treating the dust core of Patent Document 1, rapid decrease of a resistivity of the dust core was confirmed. That is, the dust core according to Patent Document 1 had a low heat resistance.

The present invention is attained in view of such circumstances, and the object is to provide a dust core having a good heat resistance, a magnetic component including the dust core, and a soft magnetic metal powder suitable for the dust core.

The present inventors have found that the reason for the dust core according to Patent Document 1 having a low heat resistance is because Fe included in the Fe-based amorphous alloy powder flows into a glass component constituting the insulation coating layer and reacts with a component included in the glass component thus causing the heat resistance of the dust core to deteriorate. Based on this finding, the present inventors have found that the heat resistance of the dust core can be improved by forming a layer interfering a movement of Fe to the coating layer between the soft magnetic metal particle including Fe and the coating layer having an insulation property, thereby the present invention has been attained.

That is, the embodiment of the present invention is

[1] a soft magnetic metal powder having soft magnetic metal particles including Fe, wherein a surface of the soft magnetic metal particle is covered by a coating part, the coating part has a first coating part, a second coating part, and a third coating part in this order from the surface of the soft magnetic metal particle towards outside, the first coating part includes oxides of Si as a main component, the second coating part includes oxides of Fe as a main component, and the third coating part includes a compound of at least one element selected from the group consisting of P, Si, Bi, and Zn.

[2] The soft magnetic metal powder according to [1], wherein a ratio of trivalent Fe atoms is 50% or more among Fe atoms of oxides of Fe included in the second coating part.

[3] The soft magnetic metal powder according to [1] or [2], wherein the third coating part includes a soft magnetic metal fine particle.

[4] The soft magnetic metal powder according to [3], wherein an aspect ratio of the soft magnetic metal fine particle is 1:2 to 1:10000.

[5] The soft magnetic metal powder according to any one of [1] to [4], wherein the soft magnetic metal particle includes a crystalline region, and an average crystallite size is 1 nm or more and 50 nm or less.

[6] The soft magnetic metal powder according to any one of [1] to [4], wherein the soft magnetic metal particle is an amorphous.

[7] A dust core constituted by the soft magnetic metal powder according to any one of [1] to [6].

[8] A magnetic component having the dust core according to [7].

According to the present invention, the dust core having a good heat resistance, the magnetic component including the dust core, and the soft magnetic metal powder suitable for the dust core can be provided.

DETAILED DESCRIPTION OF THE INVENTION

Hereinafter, the present invention is described in detail in the following order based on specific examples shown in figures.

1. Soft Magnetic Metal Powder
   - 1.1 Soft Magnetic Metal Particle
   - 1.2 Coating part
   - 1.2.1 First Coating Part
   - 1.2.2. Second Coating Part
   - 1.2.3 Third Coating Part 2. Dust Core
3. Magnetic Component
4. Method of Producing Dust Core
4.1 Method of Producing Soft Magnetic Metal Powder
4.2 Method of Producing Dust Core (1. Soft Magnetic Metal Powder)

Figure 1:
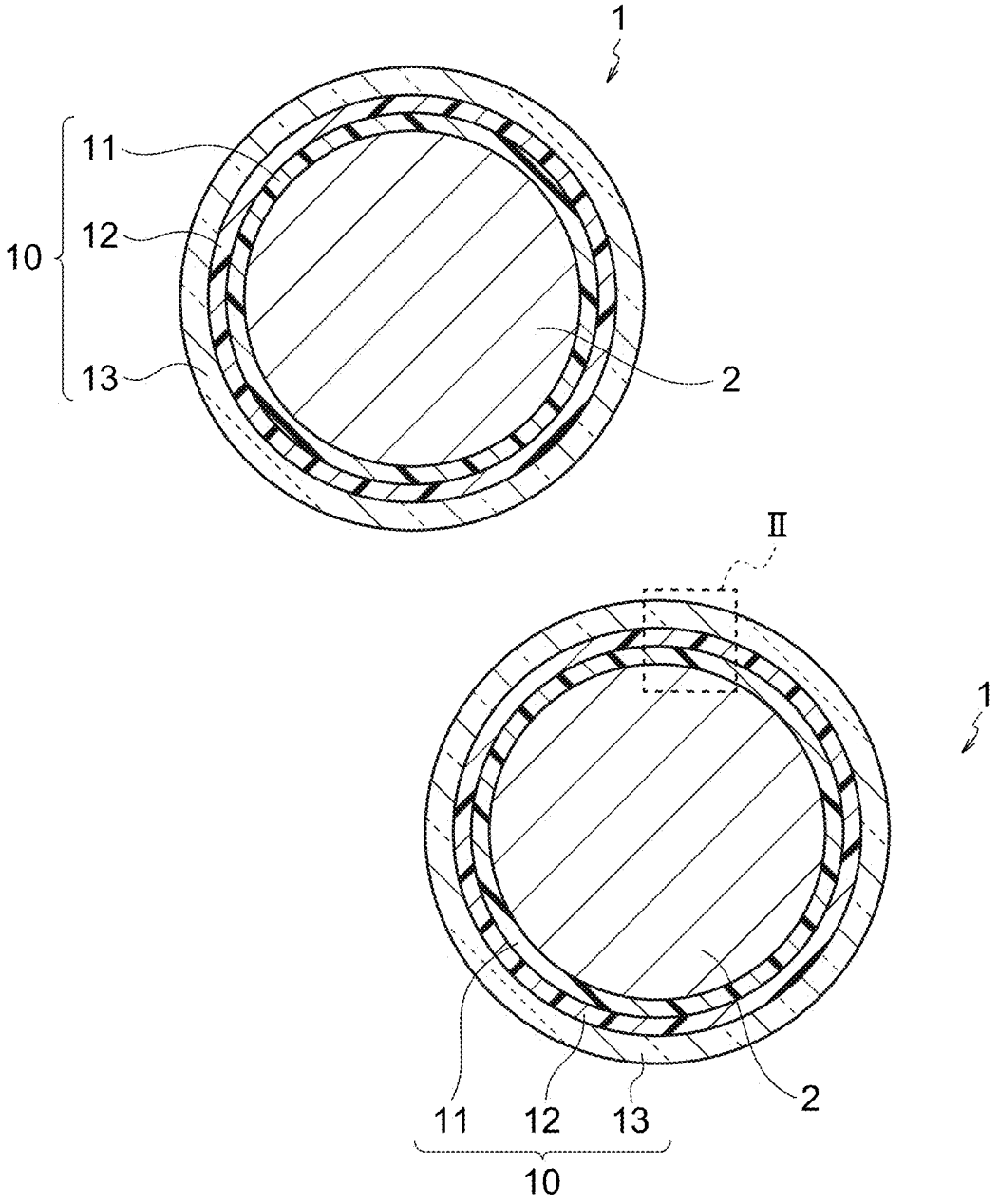
FIG. 1 is a schematic image of a cross section of a coated particle constituting soft magnetic metal powder according to the present embodiment.

As shown in FIG. 1, the soft magnetic metal powder according to the present embodiment includes coated particles of which a coating part 10 is formed to a surface of a soft magnetic metal particle 2. When a number ratio of the particle included in the soft magnetic metal powder is 100%, a number ratio of the coated particle is preferably 90% or more, and more preferably 95% or more. Note that, shape of the soft magnetic metal particle 2 is not particularly limited, and it is usually spherical.

Also, an average particle size (D50) of the soft magnetic metal powder according to the present embodiment may be selected depending on purpose of use and material. In the present embodiment, the average particle size (D50) is preferably within the range of 0.3 to 100 By setting the average particle size of the soft magnetic metal powder within the above mentioned range, sufficient moldability and predetermined magnetic properties can be easily maintained. A method of measuring the average particle size is not particularly limited, and preferably a laser diffraction scattering method is used.

(1.1 Soft Magnetic Metal Particle)

In the present embodiment, a material of the soft magnetic metal particle is not particularly limited as long as the material includes Fe and has soft magnetic property. Effects of the soft magnetic metal powder according to the present embodiment are mainly due to the coating part which is described in below, and the material of the soft magnetic metal particle has only little contribution.

As the material including Fe and having soft magnetic property, pure iron, Fe-based alloy, Fe—Si-based alloy, Fe—Al-based alloy, Fe—Ni-based alloy, Fe—Si—Al-based alloy, Fe—Si—Cr-based alloy, Fe—Ni—Si—Co-based alloy, Fe-based amorphous alloy, Fe-based nanocrystal alloy, and the like may be mentioned.

Fe-based amorphous alloy has random alignment of atoms constituting the alloy, and it is an amorphous alloy which has no crystallinity as a whole. As Fe-based amorphous alloy, for example, Fe—Si—B-based alloy, Fe—Si—B—Cr—C-based alloy, and the like may be mentioned.

Fe-based nanocrystal alloy is an alloy of which a microcrystal of a nanometer order is deposited in an amorphous by heat treating Fe-based alloy having a nanohetero structure in which an initial microcrystal exists in the amorphous.

In the present embodiment, the average crystallite size of the soft magnetic metal particle constituted by the Fe-based nanocrystal alloy is preferably 1 nm or more and 50 nm or less, and more preferably 5 nm or more and 30 nm or less. By having the average crystallite size within the above range, even when stress is applied to the particle while forming the coating part to the soft magnetic metal particle, a coercivity can be suppressed from increasing.

As Fe-based nanocrystal alloy, for example, Fe—Nb—B-based alloy, Fe—Si—Nb—B—Cu-based alloy, Fe—Si—P—B—Cu-based alloy, and the like may be mentioned.

Also, in the present embodiment, the soft magnetic metal powder may include only the soft magnetic metal particle made of same material, and also the soft magnetic metal particles having different materials may be mixed. For example, the soft magnetic metal powder may be a mixture of a plurality of types of Fe-based alloy particles and a plurality of types of Fe—Si-based alloy particles.

Note that, as an example of a different material, in case of using different elements for constituting the metal or the alloy, in case of using same elements for constituting the metal or the alloy but having different compositions, in case of having different crystal structure, and the like may be mentioned.

(1.2 Coating Part)

The coating part 10 has an insulation property, and is constituted from a first coating part 11, a second coating part 12, and a third coating part 13. The coating part 10 may include other coating part besides the first coating part 11, the second coating part 12, and the third coating part 13 as long as the coating part 10 is constituted in an order of the first coating part 11, the second coating part 12, and the third coating part 13 from the surface of the soft magnetic metal particle towards outside.

The other coating part besides the first coating part 11, the second coating part 12, and the third coating part 13 may be placed between the first coating part 11 and the surface of the soft magnetic metal particle, may be placed between the first coating part 11 and the second part 12, may be placed between the second coating part 12 and the third coating part 13, or may be placed on the third coating part.

In the present embodiment, the first coating part 11 is formed so as to cover the surface of the soft magnetic metal particle 2, the second coating part 12 is formed so as to cover the surface of the first coating part 11, and the third coating part 13 is formed so as to cover the surface of the second coating part 12.

In the present embodiment, by referring that the surface is covered by a substance, it means that the substance is in contact with the surface and the substance is fixed to cover the part which is in contact. Also, the coating part which covers the surface of the soft magnetic metal particle or the coating part only needs to cover at least part of the surface of the particle, and preferably the entire surface is covered. Further, the coating part may cover the surface continuously, or it may cover in discontinuous manner.

(1.2.1. First Coating Part)

As shown in FIG. 1, the first coating part 11 covers the surface of the soft magnetic metal particle 2. Also, the first coating part 11 is preferably constituted from oxides. In the present embodiment, the first coating part 11 includes oxides of Si as the main component. By referring "includes oxides of Si as the main component", it means that when a total content of the elements excluding oxygen included in the first coating part 11 is 100 mass %, a content of Si is the largest. In the present embodiment, 30 mass % or more of Si is preferably included with respect to a total content of 100 mass % of the elements excluding oxygen.

Since the coating part includes the first coating part, the heat resistance of the obtained dust core improves. Therefore, the resistivity of the dust core after the heat treatment can be suppressed, hence a core loss of the dust core can be reduced.

Components included in the first coating part can be identified by information such as an element analysis of Energy Dispersive X-ray Spectroscopy (EDS) using Transmission Electron Microscope (TEM), an element analysis of Electron Energy Loss Spectroscopy (EELS), a lattice constant and the like obtained from Fast Fourier Transformation (FFT) analysis of TEM image, and the like.

The thickness of the first coating part 11 is not particularly limited as long as the above mentioned effects can be obtained. In the present embodiment, the thickness of the first coating part 11 is preferably 1 nm or more and 30 nm or less. Also, more preferably it is 3 nm or more, and even more preferably it is 5 nm or more. On the other hand, it is more preferably 10 nm or less, even more preferably it is 7 nm or less.

(1.2.2. Second Coating Part)

As shown in FIG. 1, the second coating part 12 covers the surface of the first coating part 11. Also, the second coating part 12 is preferably constituted from oxides. In the present embodiment, the second coating part 12 includes oxides of Fe as the main component. By referring "includes oxides of Fe as the main component", it means that when a total content of the elements excluding oxygen included in the second coating part 12 is 100 mass %, a content of Fe is the largest. In the present embodiment, 50 mass % or more of Fe is preferably included with respect to a total content of 100 mass % of the elements excluding oxygen.

Also, the second coating part may include other component besides oxides of Fe. For example, as such component, alloy element other than Fe included in the soft magnetic metal constituting the soft magnetic metal particle may be mentioned. Specifically, oxides of at least one element selected from the group consisting of Cu, Si, Cr, B, Al, and Ni may be mentioned. These oxides may be oxides formed to the soft magnetic metal particle, or it may be oxides of element derived from alloy element included in the soft magnetic metal constituting the soft magnetic metal particle. By including oxides of these elements to the second coating part, the insulation property of the coating part can be enhanced.

Oxides of Fe are not particularly limited, and may exist as FeO, $Fe_2O_3$, and $Fe_3O_4$. Note that, in the present embodiment, a ratio of trivalent Fe is 50% or more among Fe of Fe oxides included in the second coating part 12. That is, for example, it is not preferable that FeO of which a valance of Fe is divalent is included 50% or more in the second coating part. Also, a ratio of trivalent Fe is more preferably 60% or more, and further preferably 70% or more.

As the coating part has the second coating part in addition to the first coating part, the withstand voltage property of the obtained dust core improves. Therefore, a dielectric breakdown does not occur even when high voltage is applied to the dust core which is obtained by heat curing. As a result, a rated voltage of the dust core can be increased, and also a compact dust core can be attained.

As similar to the components included in the first coating part, components included in the second coating part can be identified by information such as an element analysis of EDS using TEM, an element analysis of EELS, a lattice constant and the like obtained from FFT analysis of TEM image, and the like.

A method of analyzing whether the ratio of trivalent Fe is 50% or more among Fe included in the second coating part 12 is not particularly limited as long as it is an analysis method capable of analyzing a chemical bonding state between Fe and O. However, in the present embodiment, the second coating part is subjected to an analysis using Electron Energy Loss Spectroscopy (EELS). Specifically, Energy Loss Near Edge Structure (ELNES) which appears in EELS spectrum obtained by TEM is analyzed to obtain information regarding the chemical bonding state between Fe and O, thereby valance of Fe is calculated.

In EELS spectrum of oxides of Fe, shape of ELNES spectrum at oxygen K-edge reflects the chemical bonding state between Fe and O, and changes depending on valance of Fe. Thus, for EELS spectrum of a standard substance of $Fe_2O_3$ of which valance of Fe is trivalent and EELS spectrum of a standard substance of FeO of which valance of Fe is divalent, ELNES spectrum of oxygen K-edge of each is taken as references. Here, regarding ELNES spectrum of oxygen K-edge of $Fe_3O_4$, divalent Fe and trivalent Fe both exist in $Fe_3O_4$, and the spectrum shape is about the same as a composite shape of ELNES spectrum shape of oxygen K-edge of FeO and ELNES spectrum shape of oxygen K-edge of $Fe_2O_3$, therefore ELNES spectrum of oxygen K-edge of $Fe_3O_4$ is not used as a reference.

Note that, form of oxides of Fe existing in the second coating part is determined depending on information such as element analysis, a lattice constant, and the like, thus even if the ELNES spectrum of oxygen K-edge of $Fe_3O_4$ is not used as the reference, this does not mean that $Fe_3O_4$ does not exist in the second coating part. As a method of verifying FeO, $Fe_2O_3$, and $Fe_3O_4$, for example, a method of analyzing a diffraction pattern obtained from electronic microscope observation may be mentioned.

In order to calculate valance of Fe, ELNES spectrum of oxygen K-edge of oxides of Fe included in the second coating part is fitted by a least square method using the reference spectrum. By standardizing the fitting result so that a sum of a fitting coefficient of FeO spectrum and a fitting coefficient of $Fe_2O_3$ is 1, a ratio derived from FeO spectrum and a ratio derived from $Fe_2O_3$ spectrum with respect to ELNES spectrum of oxygen K-edge of oxides of Fe included in the second coating part can be calculated.

In the present embodiment, the ratio derived form $Fe_2O_3$ spectrum is considered as the ratio of trivalent Fe in oxides of Fe included in the second coating part, thereby the ratio of trivalent Fe is calculated.

Note that, fitting using a least square method can be done using known software and the like.

The thickness of the second coating part 12 is not particularly limited, as long as the above mentioned effects can be obtained. In the present embodiment, it is preferably 3 nm or more and 50 nm or less. More preferably it is 5 nm or more, and even more preferably it is 10 nm or more. On the other hand, it is more preferably 50 nm or less, and even more preferably 20 nm or less.

In the present embodiment, oxides of Fe included in the second coating part 12 have dense structure. As oxides of Fe have dense structure, a dielectric breakdown less likely occurs in the coating part, and the withstand voltage is enhanced. Such oxides of Fe having a dense structure can be suitably formed by heat treating in oxidized atmosphere.

On the other hand, oxides of Fe may be formed as a natural oxide film by oxidizing the surface of the soft magnetic metal particle in air. At the surface of the soft magnetic metal particle, under the presence of water, $Fe^{2+}$is generated by redox reaction, and $Fe^{3+}$ is generated by further oxidizing $Fe^{2+}$ in air. $Fe^{2+}$ and $Fe^{3+}$ coprecipitate and generate $Fe_3O_4$, and the generated $Fe_3O_4$ tends to easily fall off from the surface of the soft magnetic metal particle. Also, $Fe^{2+}$ and $Fe^{3+}$ may form hydrous iron oxides (iron hydroxide, iron oxyhydroxide, and the like) by hydrolysis, and may be included in the natural oxide film. However, the hydrous iron oxides does not form a dense structure, hence even if the natural oxide film which does not include oxides of Fe having dense structure is formed as the second coating part, the withstand voltage cannot be improved.

(1.2.3. Third Coating Part)

As shown in FIG. 1, the third coating part 13 covers the surface of the second coating part 12. In the present embodiment, the third coating part 13 includes a compound of at least one element selected from the group consisting of P, Si, Bi, and Zn. Also, the compound is preferably oxides, and more preferably oxide glass.

Also, the compound of at least one element selected from the group consisting of P, Si, Bi, and Zn is preferably included as the main component. The compound is more preferably oxides. By referring "includes oxides of at least one element selected from the group consisting of P, Si, Bi, and Zn as the main component", this means that when a total content of the elements excluding oxygen included in the third coating part 13 is 100 mass %, a total content of at least one element selected from the group consisting of P, Si, Bi, and Zn is the largest. Also, in the present embodiment, the total content of these elements are preferably 50 mass % or more, and more preferably 60 mass % or more.

The oxide glass is not particularly limited, and for example phosphate ($P_2O_5$) based glass, bismuthate ($Bi_2O_3$) based glass, borosilicate ($B_2O_3$—$SiO_2$) based glass, and the like may be mentioned.

As $P_2O_5$-based glass, a glass including 50 wt % or more of $P_2O_5$ is preferable, and for example $P_2O_5$—ZnO—$R_2O$—$Al_2O_3$-based glass and the like may be mentioned. Note that, "R" represents an alkaline metal.

As $Bi_2O_3$-based glass, a glass including 50 wt % or more of $Bi_2O_3$ is preferable, and for example $Bi_2O_3$—ZnO—$B_2O_3$—$SiO_2$—$Al_2O_3$-based glass and the like may be mentioned.

As $B_2O_3$—$SiO_2$-based glass, a glass including 10 wt % or more of $B_2O_3$ and 10 wt % or more of $SiO_2$ is preferable, and for example BaO—ZnO—$B_2O_3$—$SiO_2$—$Al_2O_3$-based glass and the like may be mentioned.

As the coating part has the third coating part, the coated particle exhibits high insulation property, therefore the resistivity of the dust core constituted by the soft magnetic metal powder including the coated particle improves. Further, the first coating part and the second coating part are placed between the soft magnetic metal particle and the third coating part, thus even when the dust core is heat treated, the movement of Fe to the third coating part is interfered. As a result, the resistivity of the dust core can be suppressed from decreasing.

Figure 2:
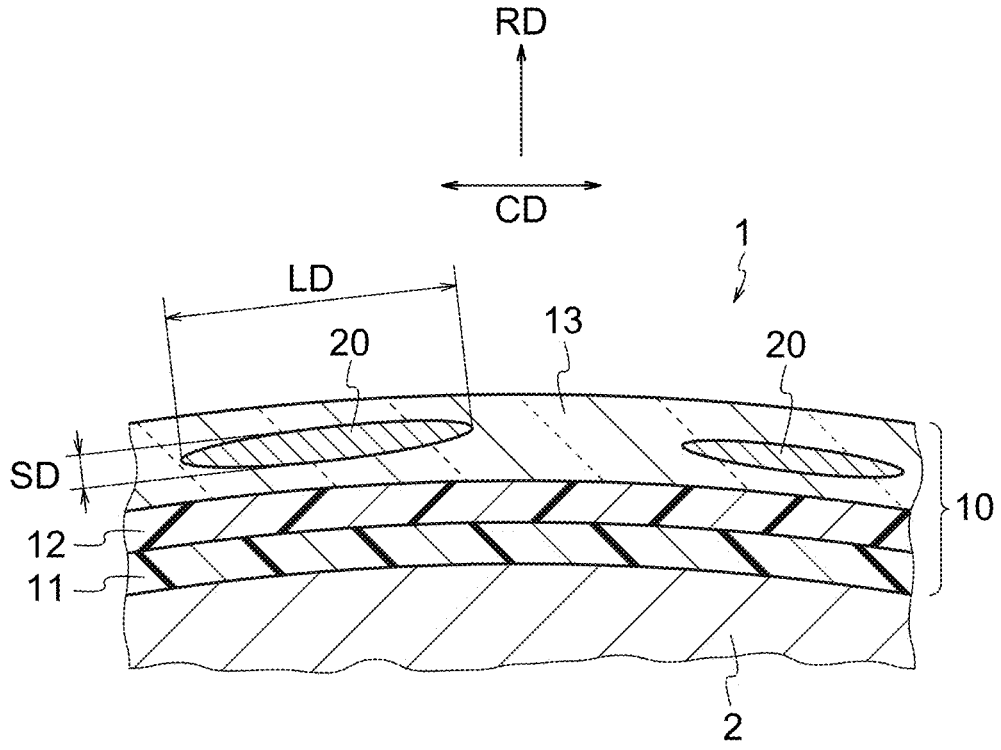
FIG. 2 is a schematic image of an enlarged cross section of II part shown in FIG. 1.

Also, in the present embodiment, as shown in FIG. 2, preferably the soft magnetic metal fine particle 20 exists inside the third coating part. For the coated particle 1, as the fine particle showing a soft magnetic property exists inside the third coating part which is the outer most layer, even when the coating part is thickened, that is even when the insulation property of the dust core is enhanced, the magnetic permeability of the dust core can be suppressed from decreasing.

Also, a short diameter direction SD of the soft magnetic metal fine particle 20 is preferably approximately parallel to a radial direction RD of the coated particle 1 rather than to a circumference direction CD of the coated particle 1; and a long diameter direction LD of the soft magnetic metal fine powder 20 is preferably approximately parallel to the circumference direction CD of the coated particle 1 rather than to the radial direction RD of the coated particle 1. By constituting as such, even when pressure is applied to each coated particle when pressure powder molding is performed to the soft magnetic metal powder according to the present embodiment, pressure applied to the soft magnetic metal fine particle 20 can be dispersed. Hence, even if the soft magnetic metal fine particle 20 exists, the coating part 10 is suppressed from breaking, and the insulation property of the dust core can be maintained.

Also, the aspect ratio calculated from the long diameter and the short diameter of the soft magnetic metal fine particle 20 is preferably 1:2 to 1: 10000 (short diameter:long diameter). Also, the aspect ratio is preferably 1:2 or larger, and more preferably 1:10 or larger. On the other hand, it is preferably 1:1000 or less, and more preferably 1:100 or less. By giving anisotropy to the shape of the soft magnetic metal fine particle 20, a magnetic flux running through the soft magnetic metal fine particle 20 does not concentrate to one point and will be dispersed. Therefore, a magnetic saturation at a contact point of the powder can be suppressed, and as a result, a good DC superimposition property of the dust core can be obtained. Note that, the long diameter of the soft magnetic metal fine particle 20 is not particularly limited as long as the soft magnetic metal fine particle 20 exists inside the third coating part 13, and for example it is 10 nm or more and 1000 nm or less.

The material of the soft magnetic metal fine particle 20 is not particularly limited as long as it exhibits the soft magnetic property. Specifically, Fe, Fe—Co-based alloy, Fe—Ni—Cr-based alloy, and the like may be mentioned. Also, it may be the same material as the soft magnetic metal particle 2 to which the coating part 10 is formed, or it may be different.

In the present embodiment, when the number ratio of the coated particle 1 included in the soft magnetic metal powder is 100%, the number ratio of the coated particle 1 having the soft magnetic metal fine particle 20 in the third coating part 13 is not particularly limited, and for example it is preferably 50% or more and 100% or less.

As similar to the components included in the first coating part, components included in the third coating part can be identified by information such as an element analysis of EDS using TEM, an element analysis of EELS, a lattice constant and the like obtained from FFT analysis of TEM image, and the like.

The thickness of the third coating part 13 is not particularly limited, as long as the above mentioned effects can be attained. In the present embodiment, the thickness is preferably 5 nm or more and 200 nm or less. More preferably, it is 7 nm or more, and even more preferably it is 10 nm or more. On the other hand, it is more preferably 100 nm or less, and even more preferably 30 nm or less.

In case the third coating part 13 includes the soft magnetic metal fine particle 20, the magnetic permeability can be suppressed from decreasing even when the third coating part is thick, thus it is preferably 150 nm or less, and more preferably it is 50 nm or less.

(2. Dust Core)

The dust core according to the present embodiment is constituted from the above mentioned soft magnetic metal powder, and it is not particularly limited as long as it is formed to have predetermined shape. In the present embodiment, the dust core includes the soft magnetic metal powder and a resin as a binder, and the soft magnetic metal powder is fixed to a predetermined shape by binding the soft magnetic metal particles constituting the soft magnetic metal powder with each other via the resin. Also, the dust core may be constituted from the mixed powder of the above mentioned soft magnetic metal powder and other magnetic powder, and may be formed into a predetermined shape.

(3. Magnetic Component)

The magnetic component according to the present embodiment is not particularly limited as long as it is provided with the above mentioned dust core. For example, it may be a magnetic component in which an air coil with a wire wound around is embedded inside the dust core having a predetermined shape, or it may be a magnetic component of which a wire is wound for a predetermined number of turns to a surface of the dust core having a predetermined shape. The magnetic component according to the present embodiment is suitable for a power inductor used for a power circuit.

(4. Method of Producing Dust Core)

Next, the method of producing the dust core included in the above mentioned magnetic component is described. First, the method of producing the soft magnetic metal powder constituting the dust core is described.

(4.1. Method of Producing Magnetic Metal Powder)

In the present embodiment, the soft magnetic metal powder before the coating part is formed can be obtained by a same method as a known method of producing the soft magnetic metal powder. Specifically, the soft magnetic metal powder can be produced using a gas atomization method, a water atomization method, a rotary disk method, and the like. Also, the soft magnetic metal powder can be produced by mechanically pulverizing a thin ribbon obtained by a single-roll method. Among these, from a point of easily obtaining the soft magnetic metal powder having desirable magnetic properties, a gas atomization method is preferably used.

In a gas atomization method, at first, a molten metal is obtained by melting the raw materials of the soft magnetic metal constituting the soft magnetic metal powder. The raw materials of each metal element (such as pure metal and the like) included in the soft magnetic metal is prepared, and these are weighed so that the composition of the soft magnetic metal obtained at end can be attained, and these raw materials are melted. Note that, the method of melting the raw materials of the metal elements is not particularly limited, and the method of melting by high frequency heating after vacuuming inside the chamber of an atomizing apparatus may be mentioned. The temperature during melting may be determined depending on the melting point of each metal element, and for example it can be 1200 to 1500° C.

The obtained molten metal is supplied into the chamber as continuous line of fluid through a nozzle provided to a bottom of a crucible, then high pressure gas is blown to the supplied molten metal to form droplets of molten metal and rapidly cooled, thereby fine powder was obtained. A gas blowing temperature, a pressure inside the chamber, and the like can be determined depending of the composition of the soft magnetic metal. Also, as for the particle size, it can be adjusted by a sieve classification, an air stream classification, and the like.

Next, the coating part is formed to the obtained soft magnetic metal particle. A method of forming the coating part is not particularly limited, and a known method can be employed. The coating part may be formed by carrying out a wet treatment to the soft magnetic metal particle, or the coating part may be formed by carrying out a dry treatment.

The first coating part can be formed by a powder spattering method, a sol-gel method, a mechanochemical coating method, and the like. In case of a powder spattering method, the soft magnetic metal particle is introduced into the barrel container, then air is vacuumed from the barrel container to make vacuumed condition. Then, the barrel container is rotated and a target which is oxides of Si placed in the barrel container is spattered to deposit on the surface of the soft magnetic metal particle, thereby the first coating part is formed. The thickness of the first coating part can be regulated by a length of time of carrying out the spattering and the like.

Also, the second coating part can be formed by heat treating in oxidized atmosphere, and by carrying out a powder spattering method as similar to the first coating part. During the heat treatment in the oxidized atmosphere, the soft magnetic metal particle formed with the first coating part is heat treated at a predetermined temperature in oxidized atmosphere, thereby Fe constituting the soft magnetic metal particle passes through the first coating part and diffuses to the surface of the first coating part, then Fe binds with oxygen in atmosphere at the surface, thus dense oxides of Fe are formed. Thereby, the second coating part can be formed. In case other metal elements constituting the soft magnetic metal particle easily diffuse, then oxides of the other elements are included in the second coating part. The thickness of the second coating part can be regulated by a heat treating temperature, a length of time of heat treatment, and the like.

Figure 3:
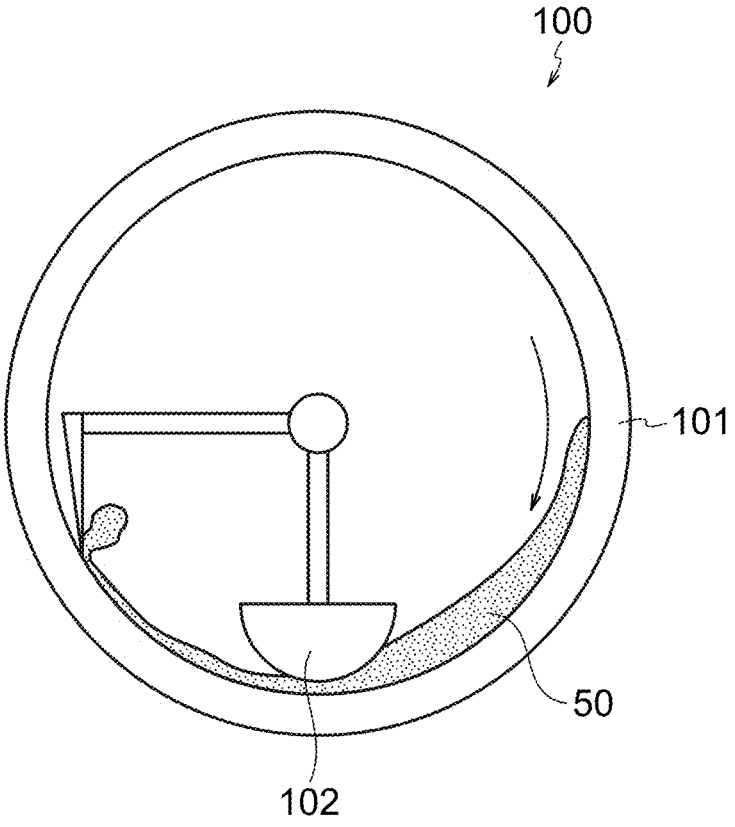
FIG. 3 is a schematic image of a cross section showing a constitution of powder coating apparatus used for forming a third coating part.

Also, the third coating part can be formed by a mechanochemical coating method, a phosphate treatment method, a sol-gel method, and the like. As the mechanochemical coating method, for example, a powder coating apparatus 100 shown in FIG. 3 is used. The soft magnetic metal powder formed with the first coating part and the second coating part, and the powder form coating material of the materials (compounds of P, Si, Bi, Zn, and the like) constituting the third coating part are introduced into a container 101 of the powder coating apparatus. After introducing these, the container 101 is rotated, thereby a mixture 50 made of the soft magnetic metal powder and the powder form coating material is compressed between a grinder 102 and an inner wall of the container 101 and heat is generated by friction. Due to this friction heat, the powder form coating material is softened, the powder form coating material is adhered to the surface of the soft magnetic metal particle by a compression effect, thereby the third coating part can be formed.

By forming the third coating part using a mechanochemical coating method, even when oxides of Fe which are not dense ($Fe_3O_4$, iron hydroxide, iron oxyhydroxide, and the like) are included in the second coating part, oxides of Fe which are not dense are removed by effects of compression and friction, hence most part of oxides of Fe included in the second coating part can be easily dense oxides of Fe which contribute to improve the withstand voltage. Note that, as oxides of Fe which are not dense are removed, the surface of the second coating part becomes relatively smooth.

In a mechanochemical coating method, a rotation speed of the container, a distance between a grinder and an inner wall of the container, and the like can be adjusted to control the heat generated by friction, thereby the temperature of the mixture of the soft magnetic metal powder and the powder form coating material can be controlled. In the present embodiment, the temperature is preferably 50° C. or higher and 150° C. or lower. By setting within such temperature range, the third coating part can be easily formed so as to cover the second coating part.

Also, in case the soft magnetic metal fine particle is included in the third coating part, the soft magnetic metal fine particle mixed in the powder form raw material may cover the soft magnetic metal particle by the above method.

(4.2. Method of Producing Dust Core)

The dust core is produced by using the above mentioned soft magnetic metal powder. A method of production is not particularly limited, and a known method can be employed. First, the soft magnetic metal powder including the soft magnetic metal particle formed with the coating part, and a known resin as the binder are mixed to obtain a mixture.

Also, if needed, the obtained mixture may be formed into granulated powder. Further, the mixture or the granulated powder is filled into a metal mold and compression molding is carried out, and a molded body having a shape of the core dust to be produced is obtained. The obtained molded body, for example, is carried out with a heat treatment at 50 to 200° C. to cure the resin, and the dust core having a predetermined shape of which the soft magnetic metal particles are fixed via the resin can be obtained. By winding a wire for a predetermined number of turns to the obtained dust core, the magnetic component such as an inductor and the like can be obtained.

Also, the above mentioned mixture or granulated powder and an air coil formed by winding a wire for predetermined number of turns may be filled in a metal mold and compress mold to embed the coil inside, thereby the molded body embedded with a coil inside may be obtained. By carrying out a heat treatment to the obtained molded body, the dust core having a predetermined shape embedded with the coil can be obtained. A coil is embedded inside of such dust core, thus it can function as the magnetic component such as an inductor and the like.

Hereinabove, the embodiment of the present invention has been described, however the present invention is not to be limited thereto, and various modifications may be done within scope of the present invention.

EXAMPLES

Hereinafter, the present invention is described in further detail using examples, however the present invention is not to be limited to these examples.

Experiments 1 to 91

First, powder including particles constituted by a soft magnetic metal having a composition shown in Table 1 and Table 2 and having an average particle size D50 shown in Table 1 and Table 2 were prepared. The prepared powder was subjected to a powder spattering using $SiO_2$ target to cover the surface of the soft magnetic metal particle, thereby the first coating part made of $SiO_2$ was formed. In the present examples, the thickness of the first coating part was 3 to 10 nm. Note that, the first coating part was not formed to samples of Experiments 1 to 12, 39, 40, 52 to 56, 74, 75, 84, and 85.

Next, the powders according to Experiments were subjected to heat treatment under the condition shown in Table 1 and Table 2. By carrying out such heat treatment, Fe and other elements constituting the soft magnetic metal particle diffuses through the first coating part and bind with oxygen at the surface of the first coating part, thereby the second coating part including oxides of Fe was formed. Note that, samples of Experiments 37, 38, 47 to 51, 72, 73, 82, and 83 were not subjected to the heat treatment, thus the second coating part did not form. Also, the samples according to Experiments 1 to 6 were left in air for 30 days, and a natural oxide film was formed on the surface of the soft magnetic metal particle as the second coating part.

Further, the powder including the particles formed with the first coating part and the second coating part was introduced to the container of the powder coating apparatus together with the powder glass (coating material) having the composition shown in Table 1 and Table 2, then the powder glass was coated on the surface of the particle formed with the first coating part and the second coating part to form the third coating part. Thereby, the soft magnetic metal powder was obtained. The powder glass was added in an amount of 3 wt % with respect to 100 wt % of the powder including the particle formed with the first coating part and the second coating part when the average particle size (D50) of the powder was 3 μm or less; the powder glass was added in an mount of 1 wt % when the average particle size (D50) of the powder was 5 μm or more and 10 μm or less; and the powder glass was added in an amount of 0.5 wt % when the average particle size (D50) of the powder was 20 μm or more. This is because the amount of the powder glass necessary for forming the predetermined thickness differs depending on the particle size of the soft magnetic metal powder to which the third coating part is formed.

Also, in the present example, for $P_2O_5$—ZnO—$R_2O$—$Al_2O_3$-based powder glass as a phosphate-based glass, $P_2O_5$ was 50 wt %, ZnO was 12 wt %, $R_2O$ was 20 wt %, $Al_2O_3$ was 6 wt %, and the rest was subcomponents.

Note that, the present inventors have carried out the same experiment to a glass having a composition including $P_2O_5$ of 60 wt %, ZnO of 20 wt %, $R_2O$ of 10 wt %, $Al_2O_3$ of 5 wt %, and the rest made of subcomponents, and the like; and have verified that the same results as mentioned in below can be obtained.

Also, in the present example, for $Bi_2O_3$—ZnO—$B_2O_3$—$SiO_2$-based powder glass as a bismuthate-based glass, $Bi_2O_3$ was 80 wt %, ZnO was 10 wt %, $B_2O_3$ was 5 wt %, and $SiO_2$ was 5 wt %. As a bismuthate-based glass, a glass having other composition was also subjected to the same experiment, and was confirmed that the same results as described in below can be obtained.

Also, in the present example, for BaO—ZnO—$B_2O_3$—$SiO_2$—$Al_2O_3$-based powder glass, as a borosilicate-based glass, BaO was 8 wt %, ZnO was 23 wt %, $B_2O_3$ was 19 wt %, $SiO_2$ was 16 wt %, $Al_2O_3$ was 6 wt %, and the rest was subcomponents. As borosilicate-based glass, a glass having other composition was also subjected to the same experiment, and was confirmed that the same results as describe in below can be obtained.

Next, the obtained soft magnetic metal powder was evaluated for the ratio of trivalent Fe among oxides of Fe included in the second coating part. Also, the soft magnetic metal powder was solidified and the resistivity was evaluated.

For the ratio of trivalent Fe, ELNES spectrum of oxygen K-edge of oxides of Fe included in the first coating part was obtained and analyzed by spherical aberration corrected STEM-EELS method. Specifically, in a field of observation of 170 nm×170 nm, ELNES spectrum of oxygen K-edge of oxides of Fe was obtained, and regarding the spectrum, fitting by a least square method using ELNES spectrum of oxygen K-edge of each standard substance of FeO and $Fe_2O_3$ was carried out.

Calibration was carried out so that a predetermined peak energy of each spectrum matches and fitting by a least square method was carried out within a range of 520 to 590 eV using MLLS fitting of Digital Micrograph made by GATAN Inc. According to results obtained by above mentioned fitting, the ratio derived from $Fe_2O_3$ spectrum was calculated, and the ratio of trivalent Fe was calculated. The results are shown in Table 1 and Table 2.

The resistivity of the powder was measured using a powder resistivity measurement apparatus, and a resistivity while applying 0.6 t/cm$^2$ of pressure to the powder was measured. In the present examples, among the samples having same average particle size (D50) of the soft magnetic metal powder, a sample showing higher resistivity than the resistivity of a sample of the comparative example was considered good. The results are shown in Table 1 and Table 2.

Next, the dust core was evaluated. The total amount of epoxy resin as a heat curing resin and imide resin as a curing agent was weighed so that it satisfied the amount shown in Table 1 with respect to 100 wt % of the obtained soft magnetic metal powder. Then, acetone was added to make a solution, and this solution and the soft magnetic metal powder were mixed. After mixing, granules obtained by evaporating acetone were sieved using 355 μm mesh. Then, this was introduced into a metal mold of toroidal shape having an outer diameter of 11 mm and an inner diameter of 6.5 mm, then molding pressure of 3.0 t/cm$^2$ was applied thereby a molded body of the dust core was obtained. The obtained molded body of the dust core was treated at 180° C. for 1 hour to cure the resin, thereby the dust core was obtained. Then, In—Ga electrodes were formed to both ends of this dust core, and the resistivity of the dust core was measured by Ultra High Resistance Meter. In the present examples, a sample having a resistivity of $10^7$ Ωcm or more was considered "Good (o)", a sample having a resistivity of $10^6$ Ωcm or more was considered "Fair (A)", and a sample having a resistivity of less than $10^6$ Ωcm was considered "Bad (x)". The results are shown in Table 1 and Table 2.

Next, the produced dust core was subjected to a heat resistance test at 250° C. for 1 hour in air. The resistivity of the sample after the heat resistance test was measured as similar to the above. In the present examples, a sample was considered "Bad (x)" when the resistivity dropped by 4 digits or more from the resistivity before the heat resistance test; a sample of which the resistivity dropped by 3 digits or less was considered "Fair (Δ)", and a sample of which the resistivity dropped by 2 digits or less was considered "Good (○)". The results are shown in Table 1 and Table 2.

Further, voltage was applied using a source meter on top and bottom of the dust core sample, and a value of voltage when 1 mA of current flew was divided by a distance between electrodes, thereby a withstand voltage was obtained. In the present examples, among the samples having same composition of the soft magnetic metal powder, same average particle size (D50), and same amount of resin used for forming the dust core; a sample showing a higher withstand voltage than the withstand voltage of a sample of the comparative example was considered good. This is because the withstand voltage changes depending on the amount of resin. The results are shown in Table 1 and Table 2.

TABLE 1

| | | Soft magnetic metal powder | | | | | | | | | | Dust core | | | |
|---|---|---|---|---|---|---|---|---|---|---|---|---|---|---|---|
| | | | | | | | | | | | | | Property | | |
| | | Soft magnetic metal particle | | | | 2nd coating part | | | | | | | | Resistivity (Ω · cm) | |
| | | | | Average particle | | Heat treating condition | | | EELS | | property Resistivity | | | Before | After heat |
| Exp. No. | Comparative example/ Example | Crystal type | Composition | size D50 (μm) | 1st coating Oxides of Si | Temp. (° C.) | Oxygen concent. (ppm) | oxides of Fe | $Fe^{3+}$ amount (%) | 3rd coating part Coating material | at 0.6 t/cm$^2$ (Ω · cm) | Resin amount (wt %) | Withstand voltage (V/mm) | heat resistance test | resistance test 250° C. × 1 h |
| 1 | Comparative example | Crystalline | Fe | 0.5 | Not formed | — | — | Formed | 34 | $P_2O_5$—ZnO—$R_2O$—$Al_2O_3$ | $3.0 \times 10^1$ | 4 | 181 | X | X |
| 2 | Comparative example | Crystalline | Fe | 1.2 | Not formed | — | — | Formed | 32 | $P_2O_5$—ZnO—$R_2O$—$Al_2O_3$ | $3.0 \times 10^2$ | 4 | 223 | X | X |
| 3 | Comparative example | Crystalline | Fe | 3 | Not formed | — | — | Formed | 33 | $P_2O_5$—ZnO—$R_2O$—$Al_2O_3$ | $3.0 \times 10^2$ | 3 | 245 | X | X |
| 4 | Comparative example | Crystalline | Fe | 5 | Not formed | — | — | Formed | 36 | $P_2O_5$—ZnO—$R_2O$—$Al_2O_3$ | $6.0 \times 10^1$ | 3 | 231 | X | X |
| 5 | Comparative example | Crystalline | Fe | 20 | Not formed | — | — | Formed | 33 | $P_2O_5$—ZnO—$R_2O$—$Al_2O_3$ | $1.0 \times 10^2$ | 2 | 98 | X | X |
| 6 | Comparative example | Crystalline | Fe | 50 | Not formed | — | — | Formed | 34 | $P_2O_5$—ZnO—$R_2O$—$Al_2O_3$ | $1.0 \times 10^2$ | 2 | 77 | X | X |
| 7 | Comparative example | Crystalline | Fe | 0.5 | Not formed | 300 | 500 | Formed | 77 | $P_2O_5$—ZnO—$R_2O$—$Al_2O_3$ | $2.0 \times 10^3$ | 4 | 345 | ○ | Δ |
| 8 | Comparative example | Crystalline | Fe | 1.2 | Not formed | 300 | 500 | Formed | 64 | $P_2O_5$—ZnO—$R_2O$—$Al_2O_3$ | $5.0 \times 10^3$ | 4 | 524 | ○ | Δ |
| 9 | Comparative example | Crystalline | Fe | 3 | Not formed | 300 | 500 | Formed | 79 | $P_2O_5$—ZnO—$R_2O$—$Al_2O_3$ | $4.0 \times 10^3$ | 3 | 454 | ○ | Δ |
| 10 | Comparative example | Crystalline | Fe | 5 | Not formed | 300 | 500 | Formed | 83 | $P_2O_5$—ZnO—$R_2O$—$Al_2O_3$ | $1.0 \times 10^5$ | 3 | 432 | ○ | Δ |
| 11 | Comparative example | Crystalline | Fe | 20 | Not formed | 300 | 500 | Formed | 72 | $P_2O_5$—ZnO—$R_2O$—$Al_2O_3$ | $2.0 \times 10^4$ | 2 | 324 | ○ | Δ |
| 12 | Comparative example | Crystalline | Fe | 50 | Not formed | 300 | 500 | Formed | 71 | $P_2O_5$—ZnO—$R_2O$—$Al_2O_3$ | $1.0 \times 10^4$ | 2 | 258 | Δ | X |
| 13 | Example | Crystalline | Fe | 0.5 | Formed | 300 | 500 | Formed | 69 | $P_2O_5$—ZnO—$R_2O$—$Al_2O_3$ | $4.0 \times 10^3$ | 4 | 366 | ○ | ○ |
| 14 | Example | Crystalline | Fe | 1.2 | Formed | 300 | 500 | Formed | 67 | $P_2O_5$—ZnO—$R_2O$—$Al_2O_3$ | $6.0 \times 10^4$ | 4 | 543 | ○ | ○ |
| 15 | Example | Crystalline | Fe | 3 | Formed | 300 | 500 | Formed | 64 | $P_2O_5$—ZnO—$R_2O$—$Al_2O_3$ | $7.0 \times 10^3$ | 4 | 482 | ○ | ○ |
| 16 | Example | Crystalline | Fe | 5 | Formed | 300 | 500 | Formed | 79 | $P_2O_5$—ZnO—$R_2O$—$Al_2O_3$ | $3.0 \times 10^5$ | 3 | 444 | ○ | ○ |
| 17 | Example | Crystalline | Fe | 20 | Formed | 300 | 500 | Formed | 83 | $P_2O_5$—ZnO—$R_2O$—$Al_2O_3$ | $5.0 \times 10^4$ | 2 | 356 | ○ | ○ |
| 18 | Example | Crystalline | Fe | 50 | Formed | 300 | 500 | Formed | 72 | $P_2O_5$—ZnO—$R_2O$—$Al_2O_3$ | $4.0 \times 10^4$ | 2 | 282 | ○ | ○ |
| 19 | Example | Crystalline | Fe | 1.2 | Formed | 200 | 1000 | Formed | 52 | $P_2O_5$—ZnO—$R_2O$—$Al_2O_3$ | $4.0 \times 10^3$ | 4 | 453 | ○ | ○ |
| 20 | Example | Crystalline | Fe | 1.2 | Formed | 300 | 100 | Formed | 65 | $P_2O_5$—ZnO—$R_2O$—$Al_2O_3$ | $5.0 \times 10^3$ | 4 | 444 | ○ | ○ |
| 21 | Example | Crystalline | Fe | 1.2 | Formed | 300 | 1000 | Formed | 66 | $P_2O_5$—ZnO—$R_2O$—$Al_2O_3$ | $5.0 \times 10^3$ | 4 | 453 | ○ | ○ |
| 22 | Example | Crystalline | Fe | 1.2 | Formed | 350 | 500 | Formed | 72 | $P_2O_5$—ZnO—$R_2O$—$Al_2O_3$ | $6.0 \times 10^3$ | 4 | 456 | ○ | ○ |
| 23 | Example | Crystalline | Fe | 1.2 | Formed | 400 | 500 | Formed | 76 | $P_2O_5$—ZnO—$R_2O$—$Al_2O_3$ | $7.0 \times 10^3$ | 4 | 534 | ○ | ○ |
| 24 | Example | Crystalline | Fe | 1.2 | Formed | 450 | 500 | Formed | 78 | $P_2O_5$—ZnO—$R_2O$—$Al_2O_3$ | $8.0 \times 10^3$ | 4 | 543 | ○ | ○ |
| 25 | Example | Crystalline | Fe | 0.5 | Formed | 300 | 500 | Formed | 78 | $Bi_2O_3$—ZnO—$B_2O_3$—$SiO_2$ | $5.0 \times 10^4$ | 4 | 398 | ○ | ○ |

TABLE 1-continued

| | | Soft magnetic metal powder | | | | | | | | | | Dust core | | | |
|---|---|---|---|---|---|---|---|---|---|---|---|---|---|---|---|
| | | | | | | | | | | | | | Property | | |
| | | Soft magnetic metal particle | | | | 2nd coating part | | | | | | | | Resistivity (Ω · cm) | |
| | | | | Average particle | | Heat treating condition | | | EELS | | property Resistivity | | | Before | After heat |
| Exp. No. | Comparative example/ Example | Crystal type | Composition | size D50 (μm) | 1st coating Oxides of Si | Temp. (° C.) | Oxygen concent. (ppm) | oxides of Fe | $Fe^{3+}$ amount (%) | 3rd coating part Coating material | at 0.6 t/cm$^2$ (Ω · cm) | Resin amount (wt %) | Withstand voltage (V/mm) | heat resistance test | resistance test 250° C. × 1 h |
| 26 | Example | Crystalline | Fe | 1.2 | Formed | 300 | 500 | Formed | 82 | $Bi_2O_3$—ZnO—$B_2O_3$—$SiO_2$ | $7.0 \times 10^5$ | 4 | 477 | ○ | ○ |
| 27 | Example | Crystalline | Fe | 3 | Formed | 300 | 500 | Formed | 83 | $Bi_2O_3$—ZnO—$B_2O_3$—$SiO_2$ | $7.0 \times 10^4$ | 4 | 456 | ○ | ○ |
| 28 | Example | Crystalline | Fe | 5 | Formed | 300 | 500 | Formed | 81 | $Bi_2O_3$—ZnO—$B_2O_3$—$SiO_2$ | $4.0 \times 10^5$ | 3 | 398 | ○ | ○ |
| 29 | Example | Crystalline | Fe | 20 | Formed | 300 | 500 | Formed | 85 | $Bi_2O_3$—ZnO—$B_2O_3$—$SiO_2$ | $6.0 \times 10^4$ | 2 | 387 | ○ | ○ |
| 30 | Example | Crystalline | Fe | 50 | Formed | 300 | 500 | Formed | 85 | $Bi_2O_3$—ZnO—$B_2O_3$—$SiO_2$ | $8.0 \times 10^4$ | 2 | 293 | ○ | ○ |
| 31 | Example | Crystalline | Fe | 0.5 | Formed | 300 | 500 | Formed | 75 | BaO—ZnO—$B_2O_3$—$SiO_2$—$Al_2O_3$ | $7.0 \times 10^4$ | 4 | 333 | ○ | ○ |
| 32 | Example | Crystalline | Fe | 1.2 | Formed | 300 | 500 | Formed | 84 | BaO—ZnO—$B_2O_3$—$SiO_2$—$Al_2O_3$ | $9.0 \times 10^5$ | 4 | 487 | ○ | ○ |
| 33 | Example | Crystalline | Fe | 3 | Formed | 300 | 500 | Formed | 84 | BaO—ZnO—$B_2O_3$—$SiO_2$—$Al_2O_3$ | $9.0 \times 10^4$ | 4 | 472 | ○ | ○ |
| 34 | Example | Crystalline | Fe | 5 | Formed | 300 | 500 | Formed | 82 | BaO—ZnO—$B_2O_3$—$SiO_2$—$Al_2O_3$ | $7.0 \times 10^5$ | 3 | 366 | ○ | ○ |
| 35 | Example | Crystalline | Fe | 20 | Formed | 300 | 500 | Formed | 84 | BaO—ZnO—$B_2O_3$—$SiO_2$—$Al_2O_3$ | $4.0 \times 10^4$ | 2 | 391 | ○ | ○ |
| 36 | Example | Crystalline | Fe | 50 | Formed | 300 | 500 | Formed | 83 | BaO—ZnO—$B_2O_3$—$SiO_2$—$Al_2O_3$ | $6.0 \times 10^4$ | 2 | 287 | ○ | ○ |
| 37 | Example | Crystalline | 93.5Fe—6.5Si | 5 | Formed | — | — | Not formed | — | $P_2O_5$—ZnO—$R_2O$—$Al_2O_3$ | $3.0 \times 10^3$ | 3 | 153 | X | X |
| 38 | Example | Crystalline | 93.5Fe—6.5Si | 20 | Formed | — | — | Not formed | — | $P_2O_5$—ZnO—$R_2O$—$Al_2O_3$ | $6.0 \times 10^3$ | 2 | 99 | X | X |
| 39 | Example | Crystalline | 93.5Fe—6.5Si | 5 | Not formed | 300 | 1000 | Formed | 65 | $P_2O_5$—ZnO—$R_2O$—$Al_2O_3$ | $7.0 \times 10^4$ | 3 | 345 | ○ | Δ |
| 40 | Example | Crystalline | 93.5Fe—6.5Si | 20 | Not formed | 300 | 1000 | Formed | 68 | $P_2O_5$—ZnO—$R_2O$—$Al_2O_3$ | $3.0 \times 10^5$ | 2 | 301 | ○ | Δ |
| 41 | Example | Crystalline | 93.5Fe—6.5Si | 5 | Formed | 300 | 1000 | Formed | 73 | $P_2O_5$—ZnO—$R_2O$—$Al_2O_3$ | $7.0 \times 10^4$ | 3 | 366 | ○ | ○ |
| 42 | Example | Crystalline | 93.5Fe—6.5Si | 20 | Formed | 300 | 1000 | Formed | 74 | $P_2O_5$—ZnO—$R_2O$—$Al_2O_3$ | $6.0 \times 10^5$ | 2 | 343 | ○ | ○ |
| 43 | Example | Crystalline | 93.5Fe—6.5Si | 5 | Formed | 300 | 1000 | Formed | 74 | $Bi_2O_3$—ZnO—$B_2O_3$—$SiO_2$ | $8.0 \times 10^4$ | 3 | 388 | ○ | ○ |
| 44 | Example | Crystalline | 93.5Fe—6.5Si | 20 | Formed | 300 | 1000 | Formed | 74 | $Bi_2O_3$—ZnO—$B_2O_3$—$SiO_2$ | $7.0 \times 10^5$ | 2 | 343 | ○ | ○ |
| 45 | Example | Crystalline | 93.5Fe—6.5Si | 5 | Formed | 300 | 1000 | Formed | 75 | BaO—ZnO—$B_2O_3$—$SiO_2$—$Al_2O_3$ | $9.0 \times 10^4$ | 3 | 381 | ○ | ○ |
| 46 | Example | Crystalline | 93.5Fe—6.5Si | 20 | Formed | 300 | 1000 | Formed | 78 | BaO—ZnO—$B_2O_3$—$SiO_2$—$Al_2O_3$ | $1.0 \times 10^6$ | 2 | 354 | ○ | ○ |

TABLE 2

| | | Soft magnetic metal powder | | | | | | | |
|---|---|---|---|---|---|---|---|---|---|
| | | | | | | 2nd coating part | | | |
| | | Soft magnetic metal particle | | | | Heat treating condition | | | EELS |
| Exp. No. | Comparative example/ Example | Crystal type | Composition | Average particle size D50 (μm) | 1st coating part Oxides of Si | Temp. (° C.) | Oxygen concent. (ppm) | oxides of Fe | $Fe^{3+}$ amount (%) |
| 47 | Comparative example | Amorphous | 87.55Fe—6.7Si—2.5Cr—2.5B—0.75C | 5 | Formed | — | — | Not formed | — |
| 48 | Comparative example | Amorphous | 87.55Fe—6.7Si—2.5Cr—2.5B—0.75C | 10 | Formed | — | — | Not formed | — |
| 49 | Comparative example | Amorphous | 87.55Fe—6.7Si—2.5Cr—2.5B—0.75C | 20 | Formed | — | — | Not formed | — |
| 50 | Comparative example | Amorphous | 87.55Fe—6.7Si—2.5Cr—2.5B—0.75C | 30 | Formed | — | — | Not formed | — |
| 51 | Comparative example | Amorphous | 87.55Fe—6.7Si—2.5Cr—2.5B—0.75C | 50 | Formed | — | — | Not formed | — |
| 52 | Comparative example | Amorphous | 87.55Fe—6.7Si—2.5Cr—2.5B—0.75C | 5 | Not formed | 300 | 2000 | Formed | 73 |
| 53 | Comparative example | Amorphous | 87.55Fe—6.7Si—2.5Cr—2.5B—0.75C | 10 | Not formed | 300 | 2000 | Formed | 74 |
| 54 | Comparative example | Amorphous | 87.55Fe—6.7Si—2.5Cr—2.5B—0.75C | 20 | Not formed | 300 | 2000 | Formed | 77 |
| 55 | Comparative example | Amorphous | 87.55Fe—6.7Si—2.5Cr—2.5B—0.75C | 30 | Not formed | 300 | 2000 | Formed | 74 |
| 56 | Comparative example | Amorphous | 87.55Fe—6.7Si—2.5Cr—2.5B—0.75C | 50 | Not formed | 300 | 2000 | Formed | 74 |
| 57 | Example | Amorphous | 87.55Fe—6.7Si—2.5Cr—2.5B—0.75C | 5 | Formed | 300 | 2000 | Formed | 72 |
| 58 | Example | Amorphous | 87.55Fe—6.7Si—2.5Cr—2.5B—0.75C | 10 | Formed | 300 | 2000 | Formed | 76 |
| 59 | Example | Amorphous | 87.55Fe—6.7Si—2.5Cr—2.5B—0.75C | 20 | Formed | 300 | 2000 | Formed | 78 |
| 60 | Example | Amorphous | 87.55Fe—6.7Si—2.5Cr—2.5B—0.75C | 30 | Formed | 300 | 2000 | Formed | 73 |
| 61 | Example | Amorphous | 87.55Fe—6.7Si—2.5Cr—2.5B—0.75C | 50 | Formed | 300 | 2000 | Formed | 74 |
| 62 | Example | Amorphous | 87.55Fe—6.7Si—2.5Cr—2.5B—0.75C | 5 | Formed | 300 | 2000 | Formed | 72 |
| 63 | Example | Amorphous | 87.55Fe—6.7Si—2.5Cr—2.5B—0.75C | 10 | Formed | 300 | 2000 | Formed | 76 |
| 64 | Example | Amorphous | 87.55Fe—6.7Si—2.5Cr—2.5B—0.75C | 20 | Formed | 300 | 2000 | Formed | 78 |
| 65 | Example | Amorphous | 87.55Fe—6.7Si—2.5Cr—2.5B—0.75C | 30 | Formed | 300 | 2000 | Formed | 73 |
| 66 | Example | Amorphous | 87.55Fe—6.7Si—2.5Cr—2.5B—0.75C | 50 | Formed | 300 | 2000 | Formed | 74 |
| 67 | Example | Amorphous | 87.55Fe—6.7Si—2.5Cr—2.5B—0.75C | 5 | Formed | 300 | 2000 | Formed | 73 |
| 68 | Example | Amorphous | 87.55Fe—6.7Si—2.5Cr—2.5B—0.75C | 10 | Formed | 300 | 2000 | Formed | 77 |
| 69 | Example | Amorphous | 87.55Fe—6.7Si—2.5Cr—2.5B—0.75C | 20 | Formed | 300 | 2000 | Formed | 76 |
| 70 | Example | Amorphous | 87.55Fe—6.7Si—2.5Cr—2.5B—0.75C | 30 | Formed | 300 | 2000 | Formed | 73 |
| 71 | Example | Amorphous | 87.55Fe—6.7Si—2.5Cr—2.5B—0.75C | 50 | Formed | 300 | 2000 | Formed | 74 |
| 72 | Comparative example | Nanocrystal | 83.4Fe—5.6Nb—2B—7.7Si—1.3Cu | 5 | Formed | — | — | Not formed | — |
| 73 | Comparative example | Nanocrystal | 83.4Fe—5.6Nb—2B—7.7Si—1.3Cu | 25 | Formed | — | — | Not formed | — |
| 74 | Comparative example | Nanocrystal | 83.4Fe—5.6Nb—2B—7.7Si—1.3Cu | 5 | Not formed | 300 | 2000 | Formed | 74 |
| 75 | Comparative example | Nanocrystal | 83.4Fe—5.6Nb—2B—7.7Si—1.3Cu | 25 | Not formed | 300 | 2000 | Formed | 79 |
| 76 | Example | Nanocrystal | 83.4Fe—5.6Nb—2B—7.7Si—1.3Cu | 5 | Formed | 300 | 2000 | Formed | 75 |
| 77 | Example | Nanocrystal | 83.4Fe—5.6Nb—2B—7.7Si—1.3Cu | 25 | Formed | 300 | 2000 | Formed | 78 |
| 78 | Example | Nanocrystal | 83.4Fe—5.6Nb—2B—7.7Si—1.3Cu | 5 | Formed | 300 | 2000 | Formed | 73 |
| 79 | Example | Nanocrystal | 83.4Fe—5.6Nb—2B—7.7Si—1.3Cu | 25 | Formed | 300 | 2000 | Formed | 78 |
| 80 | Example | Nanocrystal | 83.4Fe—5.6Nb—2B—7.7Si—1.3Cu | 5 | Formed | 300 | 2000 | Formed | 72 |
| 81 | Example | Nanocrystal | 83.4Fe—5.6Nb—2B—7.7Si—1.3Cu | 25 | Formed | 300 | 2000 | Formed | 73 |
| 82 | Comparative example | Nanocrystal | 86.2Fe—12Nb—1.8B | 5 | Formed | — | — | Not formed | — |
| 83 | Comparative example | Nanocrystal | 86.2Fe—12Nb—1.8B | 25 | Formed | — | — | Not formed | — |
| 84 | Comparative example | Nanocrystal | 86.2Fe—12Nb—1.8B | 5 | Not formed | 300 | 500 | Formed | 77 |
| 85 | Comparative example | Nanocrystal | 86.2Fe—12Nb—1.8B | 25 | Not formed | 300 | 500 | Formed | 74 |
| 86 | Example | Nanocrystal | 86.2Fe—12Nb—1.8B | 5 | Formed | 300 | 500 | Formed | 78 |
| 87 | Example | Nanocrystal | 86.2Fe—12Nb—1.8B | 25 | Formed | 300 | 500 | Formed | 75 |
| 88 | Example | Nanocrystal | 86.2Fe—12Nb—1.8B | 5 | Formed | 300 | 500 | Formed | 77 |
| 89 | Example | Nanocrystal | 86.2Fe—12Nb—1.8B | 25 | Formed | 300 | 500 | Formed | 73 |
| 90 | Example | Nanocrystal | 86.2Fe—12Nb—1.8B | 5 | Formed | 300 | 500 | Formed | 74 |
| 91 | Example | Nanocrystal | 86.2Fe—12Nb—1.8B | 25 | Formed | 300 | 500 | Formed | 72 |

TABLE 2-continued

| | | Soft magnetic metal powder | | Dust core | | | |
|---|---|---|---|---|---|---|---|
| | | | | | Property | | |
| | | | | | | Resistivity (Ω · cm) | |
| Exp. No. | Comparative example/ Example | 3rd coating part Coating material | property Resistivity at 0.6 t/cm$^2$ (Ω · cm) | Resin amount (wt %) | Withstand voltage (V/mm) | Before heat resistance test | After heat resistance test 250° C. × 1 h |
| 47 | Comparative example | $P_2O_5$—ZnO—$R_2O$—$Al_2O_3$ | $2.0 \times 10^3$ | 3 | 254 | Δ | X |
| 48 | Comparative example | $P_2O_5$—ZnO—$R_2O$—$Al_2O_3$ | $1.0 \times 10^5$ | 2 | 154 | Δ | X |
| 49 | Comparative example | $P_2O_5$—ZnO—$R_2O$—$Al_2O_3$ | $2.0 \times 10^5$ | 2 | 254 | ○ | X |
| 50 | Comparative example | $P_2O_5$—ZnO—$R_2O$—$Al_2O_3$ | $6.0 \times 10^3$ | 2 | 105 | Δ | X |
| 51 | Comparative example | $P_2O_5$—ZnO—$R_2O$—$Al_2O_3$ | $5.0 \times 10^4$ | 2 | 143 | ○ | X |
| 52 | Comparative example | $P_2O_5$—ZnO—$R_2O$—$Al_2O_3$ | $5.0 \times 10^5$ | 3 | 453 | ○ | Δ |
| 53 | Comparative example | $P_2O_5$—ZnO—$R_2O$—$Al_2O_3$ | $1.0 \times 10^7$ | 2 | 357 | ○ | Δ |
| 54 | Comparative example | $P_2O_5$—ZnO—$R_2O$—$Al_2O_3$ | $5.0 \times 10^7$ | 2 | 432 | ○ | Δ |
| 55 | Comparative example | $P_2O_5$—ZnO—$R_2O$—$Al_2O_3$ | $3.0 \times 10^6$ | 2 | 377 | ○ | Δ |
| 56 | Comparative example | $P_2O_5$—ZnO—$R_2O$—$Al_2O_3$ | $3.0 \times 10^5$ | 2 | 258 | ○ | Δ |
| 57 | Example | $P_2O_5$—ZnO—$R_2O$—$Al_2O_3$ | $6.0 \times 10^5$ | 3 | 477 | ○ | ○ |
| 58 | Example | $P_2O_5$—ZnO—$R_2O$—$Al_2O_3$ | $2.0 \times 10^7$ | 2 | 389 | ○ | ○ |
| 59 | Example | $P_2O_5$—ZnO—$R_2O$—$Al_2O_3$ | $6.0 \times 10^7$ | 2 | 466 | ○ | ○ |
| 60 | Example | $P_2O_5$—ZnO—$R_2O$—$Al_2O_3$ | $4.0 \times 10^6$ | 2 | 389 | ○ | ○ |
| 61 | Example | $P_2O_5$—ZnO—$R_2O$—$Al_2O_3$ | $1.0 \times 10^6$ | 2 | 312 | ○ | ○ |
| 62 | Example | $Bi_2O_3$—ZnO—$B_2O_3$—$SiO_2$ | $5.0 \times 10^5$ | 3 | 432 | ○ | ○ |
| 63 | Example | $Bi_2O_3$—ZnO—$B_2O_3$—$SiO_2$ | $1.0 \times 10^7$ | 2 | 399 | ○ | ○ |
| 64 | Example | $Bi_2O_3$—ZnO—$B_2O_3$—$SiO_2$ | $5.0 \times 10^7$ | 2 | 432 | ○ | ○ |
| 65 | Example | $Bi_2O_3$—ZnO—$B_2O_3$—$SiO_2$ | $2.0 \times 10^6$ | 2 | 399 | ○ | ○ |
| 66 | Example | $Bi_2O_3$—ZnO—$B_2O_3$—$SiO_2$ | $2.0 \times 10^6$ | 2 | 333 | ○ | ○ |
| 67 | Example | BaO—ZnO—$B_2O_3$—$SiO_2$—$Al_2O_3$ | $7.0 \times 10^5$ | 3 | 433 | ○ | ○ |
| 68 | Example | BaO—ZnO—$B_2O_3$—$SiO_2$—$Al_2O_3$ | $2.0 \times 10^7$ | 2 | 401 | ○ | ○ |
| 69 | Example | BaO—ZnO—$B_2O_3$—$SiO_2$—$Al_2O_3$ | $5.0 \times 10^7$ | 2 | 455 | ○ | ○ |
| 70 | Example | BaO—ZnO—$B_2O_3$—$SiO_2$—$Al_2O_3$ | $3.0 \times 10^6$ | 2 | 389 | ○ | ○ |
| 71 | Example | BaO—ZnO—$B_2O_3$—$SiO_2$—$Al_2O_3$ | $3.0 \times 10^6$ | 2 | 335 | ○ | ○ |
| 72 | Comparative example | $P_2O_5$—ZnO—$R_2O$—$Al_2O_3$ | $6.0 \times 10^4$ | 3 | 135 | Δ | X |
| 73 | Comparative example | $P_2O_5$—ZnO—$R_2O$—$Al_2O_3$ | $2.0 \times 10^6$ | 2 | 154 | Δ | X |
| 74 | Comparative example | $P_2O_5$—ZnO—$R_2O$—$Al_2O_3$ | $2.0 \times 10^6$ | 3 | 283 | ○ | Δ |
| 75 | Comparative example | $P_2O_5$—ZnO—$R_2O$—$Al_2O_3$ | $1.0 \times 10^7$ | 2 | 354 | ○ | Δ |
| 76 | Example | $P_2O_5$—ZnO—$R_2O$—$Al_2O_3$ | $4.0 \times 10^6$ | 3 | 321 | ○ | ○ |
| 77 | Example | $P_2O_5$—ZnO—$R_2O$—$Al_2O_3$ | $1.0 \times 10^7$ | 2 | 365 | ○ | ○ |
| 78 | Example | $Bi_2O_3$—ZnO—$B_2O_3$—$SiO_2$ | $4.0 \times 10^6$ | 3 | 321 | ○ | ○ |
| 79 | Example | $Bi_2O_3$—ZnO—$B_2O_3$—$SiO_2$ | $9.0 \times 10^6$ | 2 | 365 | ○ | ○ |
| 80 | Example | BaO—ZnO—$B_2O_3$—$SiO_2$—$Al_2O_3$ | $5.0 \times 10^6$ | 3 | 321 | ○ | ○ |
| 81 | Example | BaO—ZnO—$B_2O_3$—$SiO_2$—$Al_2O_3$ | $8.0 \times 10^6$ | 2 | 365 | ○ | ○ |
| 82 | Comparative example | $P_2O_5$—ZnO—$R_2O$—$Al_2O_3$ | $3.0 \times 10^3$ | 3 | 134 | Δ | X |
| 83 | Comparative example | $P_2O_5$—ZnO—$R_2O$—$Al_2O_3$ | $3.0 \times 10^5$ | 2 | 103 | ○ | X |
| 84 | Comparative example | $P_2O_5$—ZnO—$R_2O$—$Al_2O_3$ | $3.0 \times 10^4$ | 3 | 255 | ○ | Δ |
| 85 | Comparative example | $P_2O_5$—ZnO—$R_2O$—$Al_2O_3$ | $3.0 \times 10^6$ | 2 | 254 | ○ | Δ |
| 86 | Example | $P_2O_5$—ZnO—$R_2O$—$Al_2O_3$ | $7.0 \times 10^4$ | 3 | 266 | ○ | ○ |
| 87 | Example | $P_2O_5$—ZnO—$R_2O$—$Al_2O_3$ | $8.0 \times 10^6$ | 2 | 293 | ○ | ○ |
| 88 | Example | $Bi_2O_3$—ZnO—$B_2O_3$—$SiO_2$ | $6.0 \times 10^4$ | 3 | 284 | ○ | ○ |
| 89 | Example | $Bi_2O_3$—ZnO—$B_2O_3$—$SiO_2$ | $7.0 \times 10^6$ | 2 | 277 | ○ | ○ |
| 90 | Example | BaO—ZnO—$B_2O_3$—$SiO_2$—$Al_2O_3$ | $8.0 \times 10^4$ | 3 | 288 | ○ | ○ |
| 91 | Example | BaO—ZnO—$B_2O_3$—$SiO_2$—$Al_2O_3$ | $6.0 \times 10^6$ | 2 | 298 | ○ | ○ |

According to Table 1 and Table 2, in all cases of the soft magnetic metal powder having a crystalline region, the soft magnetic metal powder of amorphous type, and the soft magnetic metal powder of nanocrystal type; by forming a coating part made of a three layer structure having a predetermined composition, even when a heat treatment was carried out at 250° C., the dust core having a sufficient insulation property and good withstand voltage property can be obtained.

On the contrary to this, when the first coating part was not formed, and when the second coating part was not formed, the insulation property decreased particularly after the heat resistance test, that is it was confirmed that the heat resistance property of the dust core deteriorated. Particularly, for Experiments 1 to 6 in which the first coating part was formed and the second coating part was a natural oxide film, since the natural oxide film was not dense, the coating part had a low insulation property, and the withstand voltage and the resistivity of the dust core were extremely low.

Experiments 92 to 157

The soft magnetic metal powder was produced as same as Experiments 1 to 91 except that 0.5 wt % of powder glass for forming the third coating layer and 0.01 wt % of the soft magnetic metal fine particle having the size shown in Table 3 and Table 4 were added to 100 wt % of powder including particles formed with a first coating part having oxides of Si and thickness of 3 to 10 nm and a second coating part having oxides of Fe formed by heat treating under heat treating temperature of 300° C. and oxygen concentration of 500 ppm.

Figure 4:
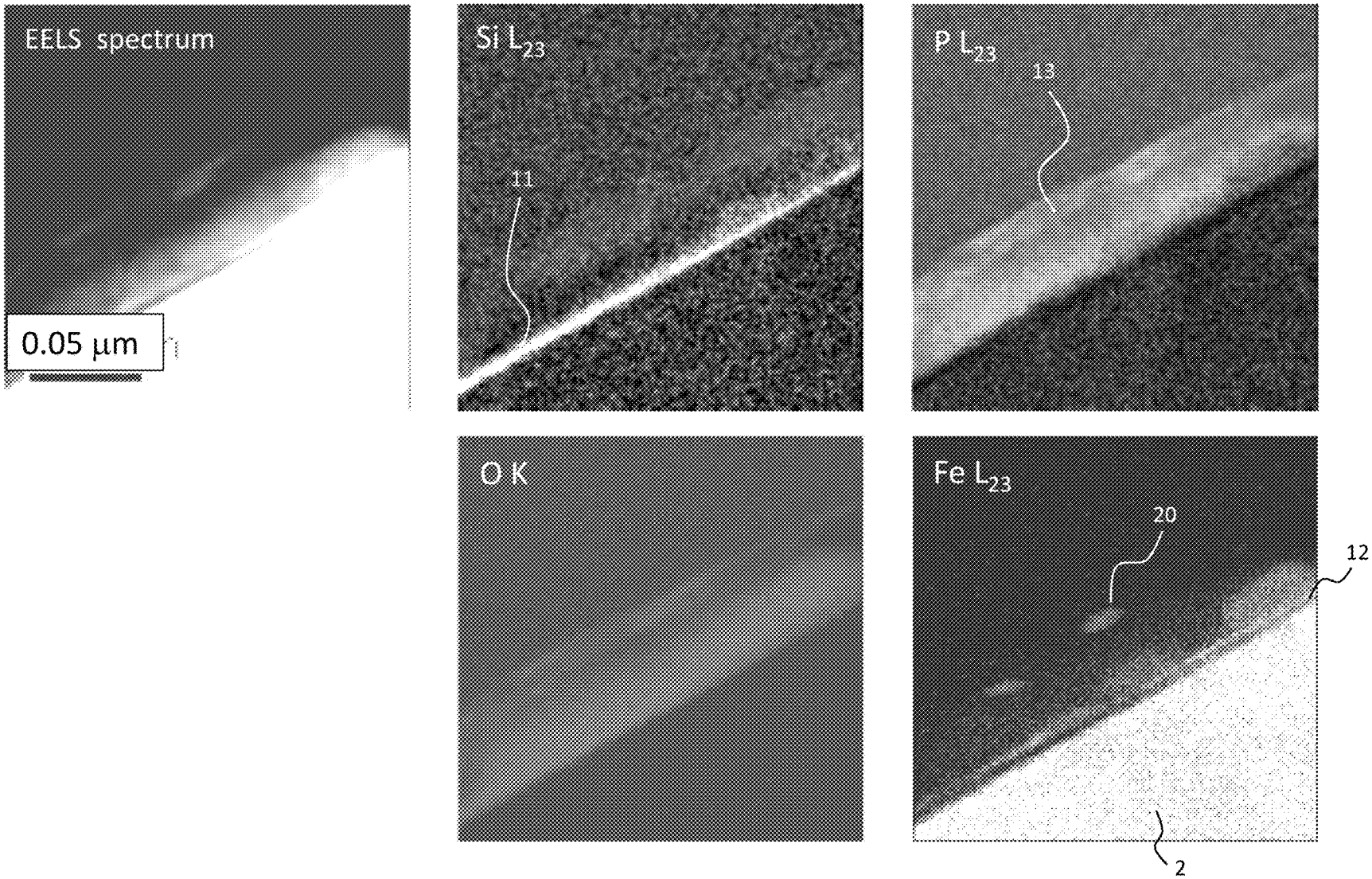
FIG. 4 is STEM-EELS spectrum image near the coating part of the coated particle in examples of the present invention.

Among the produced soft magnetic metal powder, to a sample of Experiment 109, a bright-field image near the coating part of the coated particle was obtained by STEM. FIG. 4 shows a spectrum image of EELS from the obtained bright-field image. Also, a spectrum analysis of EELS was carried out to an spectrum image of EELS shown in FIG. 4, and an element mapping was done. According to the results of EELS spectrum image shown in FIG. 4 and element mapping, it was confirmed that the coating part was constituted by the first coating part, the second coating part, and the third coating part, and that the soft magnetic metal fine particle of Fe and having an aspect ratio of 1:2 existed inside the third coating part.

Next, a sample of a dust core was produced as same as Experiment 1 except that a filling ratio of the soft magnetic metal powder occupying the dust core was adjusted so that a magnetic permeability (μ0) of the dust core of the soft magnetic metal powder including the soft magnetic metal fine particle was 27 to 28.

The magnetic permeability (μ0) and a magnetic permeability (μ8 k) of the sample of the produced dust core were measured. Also, the ratio of μ8 k with respect to the measured μ0 was calculated. This ratio indicates the rate of decrease of the magnetic permeability when DC is applied to the dust core. Therefore, this ratio shows a DC superimposition property, and the closer this ratio is to 1, the better the DC superimposition property is. Results are shown in Table 3 and Table 4.

TABLE 3

| Exp. No. | Comparative example/ Example | Soft magnetic metal powder: Soft magnetic metal particle: Crystal type | Composition | Average particle size D50 (μm) | 1st coating part: Oxides of Si | 2nd coating part: Oxides of Fe | EELS $Fe^{3+}$ amount (%) | 3rd coating part: Coating material | Soft magnetic metal fine particle: Composition | Aspect ratio | Dust core Property: Magnetic permeability μ0 | μ8k | μ8k/μ0 |
|---|---|---|---|---|---|---|---|---|---|---|---|---|---|
| 92 | Example | Crystalline | 93.5Fe—6.5Si | 20 | Formed | Formed | 68 | $P_2O_5$—ZnO—$R_2O$—$Al_2O_3$ | — | — | 28 | 21 | 0.75 |
| 93 | Example | Crystalline | 93.5Fe—6.5Si | 20 | Formed | Formed | 69 | $P_2O_5$—ZnO—$R_2O$—$Al_2O_3$ | Fe | 1:1 | 28 | 22 | 0.79 |
| 94 | Example | Crystalline | 93.5Fe—6.5Si | 20 | Formed | Formed | 66 | $P_2O_5$—ZnO—$R_2O$—$Al_2O_3$ | Fe | 1:2 | 28 | 23 | 0.81 |
| 95 | Example | Crystalline | 93.5Fe—6.5Si | 20 | Formed | Formed | 68 | $P_2O_5$—ZnO—$R_2O$—$Al_2O_3$ | Fe | 1:10 | 28 | 24 | 0.85 |
| 96 | Example | Crystalline | 93.5Fe—6.5Si | 20 | Formed | Formed | 67 | $P_2O_5$—ZnO—$R_2O$—$Al_2O_3$ | Fe | 1:100 | 28 | 24 | 0.86 |
| 97 | Example | Crystalline | 93.5Fe—6.5Si | 20 | Formed | Formed | 69 | $P_2O_5$—ZnO—$R_2O$—$Al_2O_3$ | Fe | 1:1000 | 27 | 23 | 0.87 |
| 98 | Example | Crystalline | 93.5Fe—6.5Si | 20 | Formed | Formed | 68 | $P_2O_5$—ZnO—$R_2O$—$Al_2O_3$ | Fe | 1:10000 | 28 | 25 | 0.88 |
| 99 | Example | Amorphous | 87.55Fe—6.7Si—2.5Cr—2.5B—0.75C | 20 | Formed | Formed | 75 | $P_2O_5$—ZnO—$R_2O$—$Al_2O_3$ | — | — | 28 | 18 | 0.65 |
| 100 | Example | Amorphous | 87.55Fe—6.7Si—2.5Cr—2.5B—0.75C | 20 | Formed | Formed | 75 | $P_2O_5$—ZnO—$R_2O$—$Al_2O_3$ | Fe | 1:1 | 27 | 19 | 0.72 |
| 101 | Example | Amorphous | 87.55Fe—6.7Si—2.5Cr—2.5B—0.75C | 20 | Formed | Formed | 74 | $P_2O_5$—ZnO—$R_2O$—$Al_2O_3$ | Fe | 1:2 | 28 | 21 | 0.74 |
| 102 | Example | Amorphous | 87.55Fe—6.7Si—2.5Cr—2.5B—0.75C | 20 | Formed | Formed | 75 | $P_2O_5$—ZnO—$R_2O$—$Al_2O_3$ | Fe | 1:10 | 28 | 21 | 0.75 |
| 103 | Example | Amorphous | 87.55Fe—6.7Si—2.5Cr—2.5B—0.75C | 20 | Formed | Formed | 73 | $P_2O_5$—ZnO—$R_2O$—$Al_2O_3$ | Fe | 1:100 | 28 | 22 | 0.77 |
| 104 | Example | Amorphous | 87.55Fe—6.7Si—2.5Cr—2.5B—0.75C | 20 | Formed | Formed | 78 | $P_2O_5$—ZnO—$R_2O$—$Al_2O_3$ | Fe | 1:1000 | 28 | 23 | 0.82 |
| 105 | Example | Amorphous | 87.55Fe—6.7Si—2.5Cr—2.5B—0.75C | 20 | Formed | Formed | 75 | $P_2O_5$—ZnO—$R_2O$—$Al_2O_3$ | Fe | 1:10000 | 28 | 23 | 0.83 |
| 106 | Example | Nanocrystal | 83.4Fe—5.6Nb—2B—7.7Si—1.3Cu | 25 | Formed | Formed | 79 | $P_2O_5$—ZnO—$R_2O$—$Al_2O_3$ | — | — | 29 | 19 | 0.64 |
| 107 | Example | Nanocrystal | 83.4Fe—5.6Nb—2B—7.7Si—1.3Cu | 25 | Formed | Formed | 78 | $P_2O_5$—ZnO—$R_2O$—$Al_2O_3$ | Fe | 1:1 | 28 | 19 | 0.69 |
| 108 | Example | Nanocrystal | 83.4Fe—5.6Nb—2B—7.7Si—1.3Cu | 25 | Formed | Formed | 79 | $P_2O_5$—ZnO—$R_2O$—$Al_2O_3$ | Fe | 1:2 | 28 | 20 | 0.71 |
| 109 | Example | Nanocrystal | 83.4Fe—5.6Nb—2B—7.7Si—1.3Cu | 25 | Formed | Formed | 77 | $P_2O_5$—ZnO—$R_2O$—$Al_2O_3$ | Fe | 1:10 | 28 | 20 | 0.73 |
| 110 | Example | Nanocrystal | 83.4Fe—5.6Nb—2B—7.7Si—1.3Cu | 25 | Formed | Formed | 78 | $P_2O_5$—ZnO—$R_2O$—$Al_2O_3$ | Fe | 1:100 | 28 | 21 | 0.74 |
| 111 | Example | Nanocrystal | 83.4Fe—5.6Nb—2B—7.7Si—1.3Cu | 25 | Formed | Formed | 79 | $P_2O_5$—ZnO—$R_2O$—$Al_2O_3$ | Fe | 1:1000 | 28 | 22 | 0.78 |
| 112 | Example | Nanocrystal | 83.4Fe—5.6Nb—2B—7.7Si—1.3Cu | 25 | Formed | Formed | 76 | $P_2O_5$—ZnO—$R_2O$—$Al_2O_3$ | Fe | 1:10000 | 28 | 22 | 0.79 |
| 113 | Example | Nanocrystal | 83.4Fe—5.6Nb—2B—7.7Si—1.3Cu | 25 | Formed | Formed | 78 | $P_2O_5$—ZnO—$R_2O$—$Al_2O_3$ | 70Fe—10Ni—20Cr | 1:1 | 28 | 18 | 0.63 |
| 114 | Example | Nanocrystal | 83.4Fe—5.6Nb—2B—7.7Si—1.3Cu | 25 | Formed | Formed | 77 | $P_2O_5$—ZnO—$R_2O$—$Al_2O_3$ | 70Fe—10Ni—20Cr | 1:2 | 28 | 19 | 0.67 |
| 115 | Example | Nanocrystal | 83.4Fe—5.6Nb—2B—7.7Si—1.3Cu | 25 | Formed | Formed | 79 | $P_2O_5$—ZnO—$R_2O$—$Al_2O_3$ | 70Fe—10Ni—20Cr | 1:10 | 28 | 20 | 0.70 |
| 116 | Example | Nanocrystal | 83.4Fe—5.6Nb—2B—7.7Si—1.3Cu | 25 | Formed | Formed | 75 | $P_2O_5$—ZnO—$R_2O$—$Al_2O_3$ | 70Fe—10Ni—20Cr | 1:100 | 29 | 21 | 0.71 |
| 117 | Example | Nanocrystal | 83.4Fe—5.6Nb—2B—7.7Si—1.3Cu | 25 | Formed | Formed | 78 | $P_2O_5$—ZnO—$R_2O$—$Al_2O_3$ | 70Fe—10Ni—20Cr | 1:1000 | 29 | 21 | 0.72 |
| 118 | Example | Nanocrystal | 83.4Fe—5.6Nb—2B—7.7Si—1.3Cu | 25 | Formed | Formed | 78 | $P_2O_5$—ZnO—$R_2O$—$Al_2O_3$ | 70Fe—10Ni—20Cr | 1:10000 | 28 | 22 | 0.77 |
| 119 | Example | Nanocrystal | 83.4Fe—5.6Nb—2B—7.7Si—1.3Cu | 25 | Formed | Formed | 77 | $Bi_2O_3$—ZnO—$B_2O_3SiO_2$ | — | — | 28 | 18 | 0.65 |
| 120 | Example | Nanocrystal | 83.4Fe—5.6Nb—2B—7.7Si—1.3Cu | 25 | Formed | Formed | 76 | $Bi_2O_3$—ZnO—$B_2O_3SiO_2$ | Fe | 1:1 | 29 | 20 | 0.69 |
| 121 | Example | Nanocrystal | 83.4Fe—5.6Nb—2B—7.7Si—1.3Cu | 25 | Formed | Formed | 75 | $Bi_2O_3$—ZnO—$B_2O_3SiO_2$ | Fe | 1:2 | 28 | 20 | 0.70 |
| 122 | Example | Nanocrystal | 83.4Fe—5.6Nb—2B—7.7Si—1.3Cu | 25 | Formed | Formed | 78 | $Bi_2O_3$—ZnO—$B_2O_3SiO_2$ | Fe | 1:10 | 28 | 20 | 0.73 |
| 123 | Example | Nanocrystal | 83.4Fe—5.6Nb—2B—7.7Si—1.3Cu | 25 | Formed | Formed | 77 | $Bi_2O_3$—ZnO—$B_2O_3SiO_2$ | Fe | 1:100 | 28 | 21 | 0.75 |
| 124 | Example | Nanocrystal | 83.4Fe—5.6Nb—2B—7.7Si—1.3Cu | 25 | Formed | Formed | 76 | $Bi_2O_3$—ZnO—$B_2O_3SiO_2$ | Fe | 1:1000 | 29 | 23 | 0.78 |
| 125 | Example | Nanocrystal | 83.4Fe—5.6Nb—2B—7.7Si—1.3Cu | 25 | Formed | Formed | 75 | $Bi_2O_3$—ZnO—$B_2O_3SiO_2$ | Fe | 1:10000 | 27 | 22 | 0.80 |

TABLE 4

| | | Soft magnetic metal powder | | | | | |
|---|---|---|---|---|---|---|---|
| | | Soft magnetic metal particle | | | | 2nd coating part | |
| Exp. No. | Comparative example/ Example | Crystal type | Composition | Average particle size D50 (μm) | 1st coating part Oxides of Si | Oxides of Fe | EELS $Fe^{3+}$ amount (%) |
| 126 | Example | Nanocrystal | 83.4Fe—5.6Nb—2B—7.7Si—1.3Cu | 25 | Formed | Formed | 77 |
| 127 | Example | Nanocrystal | 83.4Fe—5.6Nb—2B—7.7Si—1.3Cu | 25 | Formed | Formed | 76 |
| 128 | Example | Nanocrystal | 83.4Fe—5.6Nb—2B—7.7Si—1.3Cu | 25 | Formed | Formed | 77 |
| 129 | Example | Nanocrystal | 83.4Fe—5.6Nb—2B—7.7Si—1.3Cu | 25 | Formed | Formed | 78 |
| 130 | Example | Nanocrystal | 83.4Fe—5.6Nb—2B—7.7Si—1.3Cu | 25 | Formed | Formed | 76 |
| 131 | Example | Nanocrystal | 83.4Fe—5.6Nb—2B—7.7Si—1.3Cu | 25 | Formed | Formed | 75 |
| 132 | Example | Nanocrystal | 83.4Fe—5.6Nb—2B—7.7Si—1.3Cu | 25 | Formed | Formed | 76 |
| 133 | Example | Nanocrystal | 83.4Fe—5.6Nb—2B—7.7Si—1.3Cu | 25 | Formed | Formed | 76 |
| 134 | Example | Nanocrystal | 83.4Fe—5.6Nb—2B—7.7Si—1.3Cu | 25 | Formed | Formed | 76 |
| 135 | Example | Nanocrystal | 83.4Fe—5.6Nb—2B—7.7Si—1.3Cu | 25 | Formed | Formed | 78 |
| 136 | Example | Nanocrystal | 83.4Fe—5.6Nb—2B—7.7Si—1.3Cu | 25 | Formed | Formed | 78 |
| 137 | Example | Nanocrystal | 83.4Fe—5.6Nb—2B—7.7Si—1.3Cu | 25 | Formed | Formed | 76 |
| 138 | Example | Nanocrystal | 83.4Fe—5.6Nb—2B—7.7Si—1.3Cu | 25 | Formed | Formed | 78 |
| 139 | Example | Nanocrystal | 83.4Fe—5.6Nb—2B—7.7Si—1.3Cu | 25 | Formed | Formed | 77 |
| 140 | Example | Nanocrystal | 83.4Fe—5.6Nb—2B—7.7Si—1.3Cu | 25 | Formed | Formed | 75 |
| 141 | Example | Nanocrystal | 83.4Fe—5.6Nb—2B—7.7Si—1.3Cu | 25 | Formed | Formed | 76 |
| 142 | Example | Nanocrystal | 83.4Fe—5.6Nb—2B—7.7Si—1.3Cu | 25 | Formed | Formed | 79 |
| 143 | Example | Nanocrystal | 83.4Fe—5.6Nb—2B—7.7Si—1.3Cu | 25 | Formed | Formed | 77 |
| 144 | Example | Nanocrystal | 83.4Fe—5.6Nb—2B—7.7Si—1.3Cu | 25 | Formed | Formed | 78 |
| 145 | Example | Nanocrystal | 86.2Fe—12Nb—1.8B | 25 | Formed | Formed | 78 |
| 146 | Example | Nanocrystal | 86.2Fe—12Nb—1.8B | 25 | Formed | Formed | 76 |
| 147 | Example | Nanocrystal | 86.2Fe—12Nb—1.8B | 25 | Formed | Formed | 76 |
| 148 | Example | Nanocrystal | 86.2Fe—12Nb—1.8B | 25 | Formed | Formed | 75 |
| 149 | Example | Nanocrystal | 86.2Fe—12Nb—1.8B | 25 | Formed | Formed | 77 |
| 150 | Example | Nanocrystal | 86.2Fe—12Nb—1.8B | 25 | Formed | Formed | 76 |
| 151 | Example | Nanocrystal | 86.2Fe—12Nb—1.8B | 25 | Formed | Formed | 76 |
| 152 | Example | Nanocrystal | 86.2Fe—12Nb—1.8B | 25 | Formed | Formed | 75 |
| 153 | Example | Nanocrystal | 86.2Fe—12Nb—1.8B | 25 | Formed | Formed | 76 |
| 154 | Example | Nanocrystal | 86.2Fe—12Nb—1.8B | 25 | Formed | Formed | 77 |
| 155 | Example | Nanocrystal | 86.2Fe—12Nb—1.8B | 25 | Formed | Formed | 75 |
| 156 | Example | Nanocrystal | 86.2Fe—12Nb—1.8B | 25 | Formed | Formed | 74 |
| 157 | Example | Nanocrystal | 86.2Fe—12Nb—1.8B | 25 | Formed | Formed | 76 |

| | | Soft magnetic metal powder 3rd coating part | | | Dust core | | |
|---|---|---|---|---|---|---|---|
| | | | Soft magnetic metal fine particle | | Property Magnetic permeability | | |
| Exp. No. | Comparative example/ Example | Coating material | Composition | Aspect ratio | μ0 | μ8k | μ8k/μ0 |
| 126 | Example | $Bi_2O_3$—ZnO—$B_2O_3$—$SiO_2$ | 70Fe—10Ni—20Cr | 1:1 | 28 | 18 | 0.65 |
| 127 | Example | $Bi_2O_3$—ZnO—$B_2O_3$—$SiO_2$ | 70Fe—10Ni—20Cr | 1:2 | 29 | 19 | 0.67 |
| 128 | Example | $Bi_2O_3$—ZnO—$B_2O_3$—$SiO_2$ | 70Fe—10Ni—20Cr | 1:10 | 28 | 20 | 0.71 |
| 129 | Example | $Bi_2O_3$—ZnO—$B_2O_3$—$SiO_2$ | 70Fe—10Ni—20Cr | 1:100 | 27 | 19 | 0.72 |
| 130 | Example | $Bi_2O_3$—ZnO—$B_2O_3$—$SiO_2$ | 70Fe—10Ni—20Cr | 1:1000 | 28 | 21 | 0.75 |
| 131 | Example | $Bi_2O_3$—ZnO—$B_2O_3$—$SiO_2$ | 70Fe—10Ni—20Cr | 1:10000 | 28 | 22 | 0.78 |
| 132 | Example | BaO—ZnO—$B_2O_3$—$SiO_2$—$Al_2O_3$ | — | — | 29 | 19 | 0.65 |
| 133 | Example | BaO—ZnO—$B_2O_3$—$SiO_2$—$Al_2O_3$ | Fe | 1:1 | 28 | 19 | 0.69 |
| 134 | Example | BaO—ZnO—$B_2O_3$—$SiO_2$—$Al_2O_3$ | Fe | 1:2 | 28 | 20 | 0.71 |
| 135 | Example | BaO—ZnO—$B_2O_3$—$SiO_2$—$Al_2O_3$ | Fe | 1:10 | 28 | 20 | 0.73 |
| 136 | Example | BaO—ZnO—$B_2O_3$—$SiO_2$—$Al_2O_3$ | Fe | 1:100 | 28 | 21 | 0.74 |
| 137 | Example | BaO—ZnO—$B_2O_3$—$SiO_2$—$Al_2O_3$ | Fe | 1:1000 | 28 | 22 | 0.78 |
| 138 | Example | BaO—ZnO—$B_2O_3$—$SiO_2$—$Al_2O_3$ | Fe | 1:10000 | 27 | 21 | 0.78 |
| 139 | Example | BaO—ZnO—$B_2O_3$—$SiO_2$—$Al_2O_3$ | 70Fe—10Ni—20Cr | 1:1 | 27 | 18 | 0.66 |
| 140 | Example | BaO—ZnO—$B_2O_3$—$SiO_2$—$Al_2O_3$ | 70Fe—10Ni—20Cr | 1:2 | 28 | 19 | 0.67 |
| 141 | Example | BaO—ZnO—$B_2O_3$—$SiO_2$—$Al_2O_3$ | 70Fe—10Ni—20Cr | 1:10 | 28 | 20 | 0.71 |
| 142 | Example | BaO—ZnO—$B_2O_3$—$SiO_2$—$Al_2O_3$ | 70Fe—10Ni—20Cr | 1:100 | 28 | 20 | 0.73 |
| 143 | Example | BaO—ZnO—$B_2O_3$—$SiO_2$—$Al_2O_3$ | 70Fe—10Ni—20Cr | 1:1000 | 28 | 21 | 0.75 |
| 144 | Example | BaO—ZnO—$B_2O_3$—$SiO_2$—$Al_2O_3$ | 70Fe—10Ni—20Cr | 1:10000 | 28 | 21 | 0.76 |
| 145 | Example | $P_2O_5$—ZnO—$R_2O$—$Al_2O_3$ | — | — | 29 | 19 | 0.65 |
| 146 | Example | $P_2O_5$—ZnO—$R_2O$—$Al_2O_3$ | Fe | 1:1 | 27 | 19 | 0.72 |
| 147 | Example | $P_2O_5$—ZnO—$R_2O$—$Al_2O_3$ | Fe | 1:2 | 27 | 20 | 0.74 |
| 148 | Example | $P_2O_5$—ZnO—$R_2O$—$Al_2O_3$ | Fe | 1:10 | 28 | 21 | 0.75 |
| 149 | Example | $P_2O_5$—ZnO—$R_2O$—$Al_2O_3$ | Fe | 1:100 | 28 | 22 | 0.78 |
| 150 | Example | $P_2O_5$—ZnO—$R_2O$—$Al_2O_3$ | Fe | 1:1000 | 28 | 23 | 0.81 |
| 151 | Example | $P_2O_5$—ZnO—$R_2O$—$Al_2O_3$ | Fe | 1:10000 | 28 | 23 | 0.82 |

TABLE 4-continued

| | | | | | | | |
|---|---|---|---|---|---|---|---|
| 152 | Example | $P_2O_5$—ZnO—$R_2O$—$Al_2O_3$ | 70Fe—10Ni—20Cr | 1:1 | 28 | 20 | 0.71 |
| 153 | Example | $P_2O_5$—ZnO—$R_2O$—$Al_2O_3$ | 70Fe—10Ni—20Cr | 1:2 | 27 | 19 | 0.72 |
| 154 | Example | $P_2O_5$—ZnO—$R_2O$—$Al_2O_3$ | 70Fe—10Ni—20Cr | 1:10 | 27 | 19 | 0.72 |
| 155 | Example | $P_2O_5$—ZnO—$R_2O$—$Al_2O_3$ | 70Fe—10Ni—20Cr | 1:100 | 27 | 21 | 0.76 |
| 156 | Example | $P_2O_5$—ZnO—$R_2O$—$Al_2O_3$ | 70Fe—10Ni—20Cr | 1:1000 | 27 | 22 | 0.80 |
| 157 | Example | $P_2O_5$—ZnO—$R_2O$—$Al_2O_3$ | 70Fe—10Ni—20Cr | 1:10000 | 27 | 22 | 0.81 |

According to Table 3 and Table 4, it was confirmed that the magnetic permeability and the DC superimposition property of the dust core improved since the soft magnetic metal fine particle having a predetermined aspect ratio existed inside of the third coating part. Thus, the magnetic properties such as the magnetic permeability and the DC superimposition property were maintained while securing the insulation property between the particles.

Experiments 158 to 196

The soft magnetic metal powder was produced as same as Experiments 1 to 91 except that the thickness of the third coating part and the presence of the soft magnetic metal fine particle were constituted as shown in FIG. 3 with respect to powder including particles formed with a first coating part having oxides of Si and thickness of 3 to 10 nm and a second coating part having oxides of Fe formed by heat treating under heat treating temperature of 300° C. and oxygen concentration of 500 ppm. Using the produced soft magnetic metal powder, a sample of a dust core was produced as same as Experiments 1 to 91. For the produced dust core, the withstand voltage was evaluated, and as similar to Experiments 92 to 157, the magnetic permeability (μ0) was evaluated. The results are shown in Table 5. Note that, the third coating part was not formed to the samples of Experiments 158, 171, and 184.

TABLE 5

| | | Soft magnetic metal powder | | | | | |
|---|---|---|---|---|---|---|---|
| | | Soft magnetic metal particle | | | | 2nd coating part | |
| Exp. No. | Comparative example/ Example | Crystal type | Composition | Average particle size D50 (μm) | 1st coating part Oxides of Si | Oxides of Fe | EELS $Fe^{3+}$ amount (%) |
| 158 | Comparative example | Amorphous | 87.55Fe—6.7Si—2.5Cr—2.5B—0.75C | 20 | Formed | Formed | 75 |
| 159 | Example | Amorphous | 87.55Fe—6.7Si—2.5Cr—2.5B—0.75C | 20 | Formed | Formed | 75 |
| 160 | Example | Amorphous | 87.55Fe—6.7Si—2.5Cr—2.5B—0.75C | 20 | Formed | Formed | 75 |
| 161 | Example | Amorphous | 87.55Fe—6.7Si—2.5Cr—2.5B—0.75C | 20 | Formed | Formed | 75 |
| 162 | Example | Amorphous | 87.55Fe—6.7Si—2.5Cr—2.5B—0.75C | 20 | Formed | Formed | 75 |
| 163 | Example | Amorphous | 87.55Fe—6.7Si—2.5Cr—2.5B—0.75C | 20 | Formed | Formed | 75 |
| 164 | Example | Amorphous | 87.55Fe—6.7Si—2.5Cr—2.5B—0.75C | 20 | Formed | Formed | 75 |
| 165 | Example | Amorphous | 87.55Fe—6.7Si—2.5Cr—2.5B—0.75C | 20 | Formed | Formed | 75 |
| 166 | Example | Amorphous | 87.55Fe—6.7Si—2.5Cr—2.5B—0.75C | 20 | Formed | Formed | 75 |
| 167 | Example | Amorphous | 87.55Fe—6.7Si—2.5Cr—2.5B—0.75C | 20 | Formed | Formed | 75 |
| 168 | Example | Amorphous | 87.55Fe—6.7Si—2.5Cr—2.5B—0.75C | 20 | Formed | Formed | 75 |
| 169 | Example | Amorphous | 87.55Fe—6.7Si—2.5Cr—2.5B—0.75C | 20 | Formed | Formed | 75 |
| 170 | Example | Amorphous | 87.55Fe—6.7Si—2.5Cr—2.5B—0.75C | 20 | Formed | Formed | 75 |
| 171 | Comparative example | Nanocrystal | 83.4Fe—5.6Nb—2B—7.7Si—1.3Cu | 25 | Formed | Formed | 78 |
| 172 | Example | Nanocrystal | 83.4Fe—5.6Nb—2B—7.7Si—1.3Cu | 25 | Formed | Formed | 78 |
| 173 | Example | Nanocrystal | 83.4Fe—5.6Nb—2B—7.7Si—1.3Cu | 25 | Formed | Formed | 78 |
| 174 | Example | Nanocrystal | 83.4Fe—5.6Nb—2B—7.7Si—1.3Cu | 25 | Formed | Formed | 78 |
| 175 | Example | Nanocrystal | 83.4Fe—5.6Nb—2B—7.7Si—1.3Cu | 25 | Formed | Formed | 78 |
| 176 | Example | Nanocrystal | 83.4Fe—5.6Nb—2B—7.7Si—1.3Cu | 25 | Formed | Formed | 78 |
| 177 | Example | Nanocrystal | 83.4Fe—5.6Nb—2B—7.7Si—1.3Cu | 25 | Formed | Formed | 78 |
| 178 | Example | Nanocrystal | 83.4Fe—5.6Nb—2B—7.7Si—1.3Cu | 25 | Formed | Formed | 78 |
| 179 | Example | Nanocrystal | 83.4Fe—5.6Nb—2B—7.7Si—1.3Cu | 25 | Formed | Formed | 78 |
| 180 | Example | Nanocrystal | 83.4Fe—5.6Nb—2B—7.7Si—1.3Cu | 25 | Formed | Formed | 78 |
| 181 | Example | Nanocrystal | 83.4Fe—5.6Nb—2B—7.7Si—1.3Cu | 25 | Formed | Formed | 78 |
| 182 | Example | Nanocrystal | 83.4Fe—5.6Nb—2B—7.7Si—1.3Cu | 25 | Formed | Formed | 78 |
| 183 | Example | Nanocrystal | 83.4Fe—5.6Nb—2B—7.7Si—1.3Cu | 25 | Formed | Formed | 78 |
| 184 | Comparative example | Crystalline | 93.5Fe—6.5Si | 20 | Formed | Formed | 75 |
| 185 | Example | Crystalline | 93.5Fe—6.5Si | 20 | Formed | Formed | 75 |
| 186 | Example | Crystalline | 93.5Fe—6.5Si | 20 | Formed | Formed | 75 |
| 187 | Example | Crystalline | 93.5Fe—6.5Si | 20 | Formed | Formed | 75 |
| 188 | Example | Crystalline | 93.5Fe—6.5Si | 20 | Formed | Formed | 75 |
| 189 | Example | Crystalline | 93.5Fe—6.5Si | 20 | Formed | Formed | 75 |
| 190 | Example | Crystalline | 93.5Fe—6.5Si | 20 | Formed | Formed | 75 |
| 191 | Example | Crystalline | 93.5Fe—6.5Si | 20 | Formed | Formed | 75 |
| 192 | Example | Crystalline | 93.5Fe—6.5Si | 20 | Formed | Formed | 75 |
| 193 | Example | Crystalline | 93.5Fe—6.5Si | 20 | Formed | Formed | 75 |
| 194 | Example | Crystalline | 93.5Fe—6.5Si | 20 | Formed | Formed | 75 |

TABLE 5-continued

| | | | | | | | | |
|---|---|---|---|---|---|---|---|---|
| 195 | Example | Crystalline | 93.5Fe—6.5Si | 20 | Formed | Formed | 75 |
| 196 | Example | Crystalline | 93.5Fe—6.5Si | 20 | Formed | Formed | 75 |

| | | Soft magnetic metal powder 3rd coating part | | | | Dust core | | |
|---|---|---|---|---|---|---|---|---|
| | | | | Soft magnetic metal | | | Property | |
| Exp. No. | Comparative example/ Example | Coating material | Thickness (nm) | Comp. | Aspect ratio | Resin amount (wt %) | Magnetic permeability μ0 | Withstand voltage (V/mm) |
| 158 | Comparative example | — | — | — | — | 3 | 29 | 108 |
| 159 | Example | $P_2O_5$—ZnO—$R_2O$—$Al_2O_3$ | 1 | — | — | 3 | 29 | 232 |
| 160 | Example | $P_2O_5$—ZnO—$R_2O$—$Al_2O_3$ | 5 | — | — | 3 | 28 | 321 |
| 161 | Example | $P_2O_5$—ZnO—$R_2O$—$Al_2O_3$ | 20 | — | — | 3 | 28 | 466 |
| 162 | Example | $P_2O_5$—ZnO—$R_2O$—$Al_2O_3$ | 50 | — | — | 3 | 26 | 521 |
| 163 | Example | $P_2O_5$—ZnO—$R_2O$—$Al_2O_3$ | 100 | — | — | 3 | 24 | 612 |
| 164 | Example | $P_2O_5$—ZnO—$R_2O$—$Al_2O_3$ | 150 | — | — | 3 | 23 | 654 |
| 165 | Example | $P_2O_5$—ZnO—$R_2O$—$Al_2O_3$ | 200 | — | — | 3 | 22 | 677 |
| 166 | Example | $P_2O_5$—ZnO—$R_2O$—$Al_2O_3$ | 20 | Fe | 1:2 | 3 | 29 | 432 |
| 167 | Example | $P_2O_5$—ZnO—$R_2O$—$Al_2O_3$ | 50 | Fe | 1:2 | 3 | 28 | 511 |
| 168 | Example | $P_2O_5$—ZnO—$R_2O$—$Al_2O_3$ | 100 | Fe | 1:2 | 3 | 27 | 615 |
| 169 | Example | $P_2O_5$—ZnO—$R_2O$—$Al_2O_3$ | 150 | Fe | 1:2 | 3 | 26 | 672 |
| 170 | Example | $P_2O_5$—ZnO—$R_2O$—$Al_2O_3$ | 200 | Fe | 1:2 | 3 | 26 | 721 |
| 171 | Comparative example | — | — | — | — | 3 | 29 | 82 |
| 172 | Example | $P_2O_5$—ZnO—$R_2O$—$Al_2O_3$ | 1 | — | — | 3 | 28 | 187 |
| 173 | Example | $P_2O_5$—ZnO—$R_2O$—$Al_2O_3$ | 5 | — | — | 3 | 28 | 271 |
| 174 | Example | $P_2O_5$—ZnO—$R_2O$—$Al_2O_3$ | 20 | — | — | 3 | 28 | 365 |
| 175 | Example | $P_2O_5$—ZnO—$R_2O$—$Al_2O_3$ | 50 | — | — | 3 | 26 | 412 |
| 176 | Example | $P_2O_5$—ZnO—$R_2O$—$Al_2O_3$ | 100 | — | — | 3 | 25 | 523 |
| 177 | Example | $P_2O_5$—ZnO—$R_2O$—$Al_2O_3$ | 150 | — | — | 3 | 23 | 563 |
| 178 | Example | $P_2O_5$—ZnO—$R_2O$—$Al_2O_3$ | 200 | — | — | 3 | 22 | 591 |
| 179 | Example | $P_2O_5$—ZnO—$R_2O$—$Al_2O_3$ | 20 | Fe | 1:2 | 3 | 30 | 388 |
| 180 | Example | $P_2O_5$—ZnO—$R_2O$—$Al_2O_3$ | 50 | Fe | 1:2 | 3 | 29 | 512 |
| 181 | Example | $P_2O_5$—ZnO—$R_2O$—$Al_2O_3$ | 100 | Fe | 1:2 | 3 | 28 | 538 |
| 182 | Example | $P_2O_5$—ZnO—$R_2O$—$Al_2O_3$ | 150 | Fe | 1:2 | 3 | 27 | 566 |
| 183 | Example | $P_2O_5$—ZnO—$R_2O$—$Al_2O_3$ | 200 | Fe | 1:2 | 3 | 26 | 591 |
| 184 | Comparative example | — | — | — | — | 3 | 28 | 99 |
| 185 | Example | $P_2O_5$—ZnO—$R_2O$—$Al_2O_3$ | 1 | — | — | 3 | 27 | 204 |
| 186 | Example | $P_2O_5$—ZnO—$R_2O$—$Al_2O_3$ | 5 | — | — | 3 | 28 | 253 |
| 187 | Example | $P_2O_5$—ZnO—$R_2O$—$Al_2O_3$ | 20 | — | — | 3 | 27 | 343 |
| 188 | Example | $P_2O_5$—ZnO—$R_2O$—$Al_2O_3$ | 50 | — | — | 3 | 28 | 382 |
| 189 | Example | $P_2O_5$—ZnO—$R_2O$—$Al_2O_3$ | 100 | — | — | 3 | 29 | 454 |
| 190 | Example | $P_2O_5$—ZnO—$R_2O$—$Al_2O_3$ | 150 | — | — | 3 | 29 | 543 |
| 191 | Example | $P_2O_5$—ZnO—$R_2O$—$Al_2O_3$ | 200 | — | — | 3 | 27 | 677 |
| 192 | Example | $P_2O_5$—ZnO—$R_2O$—$Al_2O_3$ | 20 | Fe | 1:2 | 3 | 28 | 323 |
| 193 | Example | $P_2O_5$—ZnO—$R_2O$—$Al_2O_3$ | 50 | Fe | 1:2 | 3 | 27 | 392 |
| 194 | Example | $P_2O_5$—ZnO—$R_2O$—$Al_2O_3$ | 100 | Fe | 1:2 | 3 | 26 | 432 |
| 195 | Example | $P_2O_5$—ZnO—$R_2O$—$Al_2O_3$ | 150 | Fe | 1:2 | 3 | 27 | 534 |
| 196 | Example | $P_2O_5$—ZnO—$R_2O$—$Al_2O_3$ | 200 | Fe | 1:2 | 3 | 26 | 621 |

According to Table 5, by setting the thickness of the third coating part within the predetermined range, it was confirmed that the dust core can attain both the insulation property and the withstand voltage property. Also, it was confirmed that even when the coating part was thick, the DC superimposition property of the dust core did not decrease because the soft magnetic metal fine particle having a predetermined aspect ratio existed inside the third coating part.

On the contrary to this, in case the third coating part is not formed, it was confirmed that the withstand voltage of the dust core deteriorated.

Experiments 197 to 224

The powder including particles constituted from the soft magnetic metal having the composition shown in Table 6 and having the average particle size (D50) shown in Table 6 was prepared, then as similar to Experiments 1 to 91, the first coating part having oxides of Si and thickness of 3 to 10 nm was formed; also the second coating part having oxides of Fe by heat treatment condition shown in Table 6 was formed.

The third coating part was formed to the powder including the particle formed with the first coating part and the second coating part as similar to Experiments 1 to 91 except that a coating material having the composition shown in Table 6 was used.

In the present examples, the coercivity of the powder before forming the third coating part and the coercivity of the powder after forming the third coating part were measured. 20 mg of powder and paraffin were placed in a plastic case of ϕ6 mm×5 mm, and the paraffin was melted and solidified to fix the powder, thereby the coercivity was measured using a coercimeter (K-HC1000) made by TOHOKU STEEL Co., Ltd. A magnetic field was 150 kA/m while measuring the coercivity. Also, a ratio of the coercivity before and after forming the third coating part was calculated. The results are shown in Table 6.

Also, the powder before forming the third coating part was subjected to X-ray diffraction analysis and the average crystallite size was calculated. The results are shown in Table 6. Note that, the samples of Experiments 204 to 208 were amorphous, hence the crystallite size was not measured.

Note that, Experiment 197 of Table 6 is Experiment 14 of Table 1, Experiments 204 to 206 of Table 6 are Experiments 57 to 61 of Table 2, Experiments 209 and 210 of Table 6 are Experiments 76 and 77 of Table 2, Experiments 211 and 212 are Experiments 86 and 87 of Table 2, and Experiments 218 and 219 of Table 6 are Experiments 41 and 42 of Table 1.

TABLE 6

| | | Soft magnetic metal powder | | | | | | | |
|---|---|---|---|---|---|---|---|---|---|
| | | Soft magnetic metal particle | | | | 2nd coating part | | | |
| | | | | | | Heat treating condition | | | |
| Exp. No. | Comparative example/ Example | Crystal type | Composition | Average particle size D50 (μm) | 1st coating part Oxides of Si | Temp. (° C.) | Oxygen concent. (ppm) | Oxides of Fe | EELS $Fe^{3+}$ amount (%) |
| 197 | Example | Crystalline | Fe | 1.2 | Formed | 300 | 500 | Formed | 67 |
| 198 | Example | Crystalline | Fe | 1.2 | Formed | 350 | 500 | Formed | 72 |
| 199 | Example | Crystalline | Fe | 1.2 | Formed | 400 | 500 | Formed | 76 |
| 200 | Example | Crystalline | Fe | 1.2 | Formed | 450 | 500 | Formed | 78 |
| 201 | Example | Crystalline | 55Fe—45Ni | 5.0 | Formed | 300 | 500 | Formed | 74 |
| 202 | Example | Crystalline | 55Fe—45Ni | 5.0 | Formed | 300 | 500 | Formed | 74 |
| 203 | Example | Crystalline | 16Fe—79Ni—5Mo | 1.2 | Formed | 300 | 500 | Formed | 73 |
| 204 | Example | Amorphous | 87.55Fe—6.7Si—2.5Cr—2.5B—0.75C | 5 | Formed | 300 | 2000 | Formed | 72 |
| 205 | Example | Amorphous | 87.55Fe—6.7Si—2.5Cr—2.5B—0.75C | 10 | Formed | 300 | 2000 | Formed | 76 |
| 206 | Example | Amorphous | 87.55Fe—6.7Si—2.5Cr—2.5B—0.75C | 20 | Formed | 300 | 2000 | Formed | 78 |
| 207 | Example | Amorphous | 87.55Fe—6.7Si—2.5Cr—2.5B—0.75C | 30 | Formed | 300 | 2000 | Formed | 73 |
| 208 | Example | Amorphous | 87.55Fe—6.7Si—2.5Cr—2.5B—0.75C | 50 | Formed | 300 | 2000 | Formed | 74 |
| 209 | Example | Nanocrystal | 83.4Fe—5.6Nb—2B—7.7Si—1.3Cu | 5 | Formed | 300 | 2000 | Formed | 75 |
| 210 | Example | Nanocrystal | 83.4Fe—5.6Nb—2B—7.7Si—1.3Cu | 25 | Formed | 300 | 2000 | Formed | 78 |
| 211 | Example | Nanocrystal | 86.2Fe—12Nb—1.8B | 5 | Formed | 300 | 500 | Formed | 78 |
| 212 | Example | Nanocrystal | 86.2Fe—12Nb—1.8B | 25 | Formed | 300 | 500 | Formed | 75 |
| 213 | Example | Crystalline | 90.5Fe—4.5Si—5Cr | 5 | Formed | 300 | 1000 | Formed | 73 |
| 214 | Example | Crystalline | 90.5Fe—4.5Si—5Cr | 20 | Formed | 300 | 1000 | Formed | 77 |
| 215 | Example | Crystalline | 90.5Fe—4.5Si—5Cr | 30 | Formed | 300 | 1000 | Formed | 74 |
| 216 | Example | Crystalline | 90.5Fe—4.5Si—5Cr | 50 | Formed | 300 | 1000 | Formed | 74 |
| 217 | Example | Crystalline | 90Fe—10Si | 20 | Formed | 300 | 1000 | Formed | 77 |
| 218 | Example | Crystalline | 93.5Fe—6.5Si | 5 | Formed | 300 | 1000 | Formed | 73 |
| 219 | Example | Crystalline | 93.5Fe—6.5Si | 20 | Formed | 300 | 1000 | Formed | 74 |
| 220 | Example | Crystalline | 95.5Fe—4.5Si | 20 | Formed | 300 | 1000 | Formed | 73 |
| 221 | Example | Crystalline | 98Fe—3Si | 20 | Formed | 300 | 1000 | Formed | 77 |
| 222 | Example | Crystalline | 85Fe—9.5Si—5.5Al | 10 | Formed | 300 | 1000 | Formed | 73 |
| 223 | Example | Crystalline | 50.5Fe—44.5Ni—2Si—3Co | 5 | Formed | 300 | 1000 | Formed | 77 |
| 224 | Example | Crystalline | 50.5Fe—44.5Ni—2Si—3Co | 20 | Formed | 300 | 1000 | Formed | 74 |

| | | | Before forming 3rd coating part | | After forming | |
|---|---|---|---|---|---|---|
| Exp. No. | Comparative example/ Example | Soft magnetic metal powder 3rd coating part Coating material | Average crystallite size (nm) | Coercivity (Oe) | 3rd coating part Coercivity (Oe) | After/ Before |
| 197 | Example | $P_2O_5$—ZnO—$R_2O$—$Al_2O_3$ | 10 | 10 | 12 | 1.2 |
| 198 | Example | $P_2O_5$—ZnO—$R_2O$—$Al_2O_3$ | 35 | 20 | 21 | 1.1 |
| 199 | Example | $P_2O_5$—ZnO—$R_2O$—$Al_2O_3$ | 50 | 25 | 28 | 1.1 |
| 200 | Example | $P_2O_5$—ZnO—$R_2O$—$Al_2O_3$ | 80 | 135 | 321 | 2.4 |
| 201 | Example | $P_2O_5$—ZnO—$R_2O$—$Al_2O_3$ | 1000 | 9 | 21 | 2.3 |
| 202 | Example | $P_2O_5$—ZnO—$R_2O$—$Al_2O_3$ | 3200 | 9 | 23 | 2.6 |
| 203 | Example | $P_2O_5$—ZnO—$R_2O$—$Al_2O_3$ | 150 | 10 | 22 | 2.2 |
| 204 | Example | $P_2O_5$—ZnO—$R_2O$—$Al_2O_3$ | Amorphous | 8 | 11 | 1.4 |
| 205 | Example | $P_2O_5$—ZnO—$R_2O$—$Al_2O_3$ | Amorphous | 1.8 | 3.2 | 1.8 |
| 206 | Example | $P_2O_5$—ZnO—$R_2O$—$Al_2O_3$ | Amorphous | 2.6 | 4.5 | 1.7 |
| 207 | Example | $P_2O_5$—ZnO—$R_2O$—$Al_2O_3$ | Amorphous | 2.5 | 3.9 | 1.6 |
| 208 | Example | $P_2O_5$—ZnO—$R_2O$—$Al_2O_3$ | Amorphous | 3.8 | 7.2 | 1.9 |
| 209 | Example | $P_2O_5$—ZnO—$R_2O$—$Al_2O_3$ | 24 | 0.6 | 0.9 | 1.5 |
| 210 | Example | $P_2O_5$—ZnO—$R_2O$—$Al_2O_3$ | 24 | 0.7 | 0.9 | 1.3 |
| 211 | Example | $P_2O_5$—ZnO—$R_2O$—$Al_2O_3$ | 10 | 2.1 | 2.4 | 1.1 |
| 212 | Example | $P_2O_5$—ZnO—$R_2O$—$Al_2O_3$ | 11 | 1.6 | 1.8 | 1.1 |
| 213 | Example | $P_2O_5$—ZnO—$R_2O$—$Al_2O_3$ | 1000 | 8 | 23 | 2.9 |
| 214 | Example | $P_2O_5$—ZnO—$R_2O$—$Al_2O_3$ | 2000 | 7 | 23 | 3.3 |
| 215 | Example | $P_2O_5$—ZnO—$R_2O$—$Al_2O_3$ | 2000 | 6 | 24 | 4.0 |
| 216 | Example | $P_2O_5$—ZnO—$R_2O$—$Al_2O_3$ | 2000 | 6 | 22 | 3.7 |

TABLE 6-continued

| | | | | | | |
|---|---|---|---|---|---|---|
| 217 | Example | $P_2O_5$—ZnO—$R_2O$—$Al_2O_3$ | 3000 | 6 | 15 | 2.5 |
| 218 | Example | $P_2O_5$—ZnO—$R_2O$—$Al_2O_3$ | 1300 | 7 | 18 | 2.6 |
| 219 | Example | $P_2O_5$—ZnO—$R_2O$—$Al_2O_3$ | 3400 | 5 | 18 | 3.6 |
| 220 | Example | $P_2O_5$—ZnO—$R_2O$—$Al_2O_3$ | 3500 | 7 | 16 | 2.3 |
| 221 | Example | $P_2O_5$—ZnO—$R_2O$—$Al_2O_3$ | 3300 | 9 | 19 | 2.1 |
| 222 | Example | $P_2O_5$—ZnO—$R_2O$—$Al_2O_3$ | 3300 | 9 | 22 | 2.4 |
| 223 | Example | $P_2O_5$—ZnO—$R_2O$—$Al_2O_3$ | 1200 | 7 | 22 | 3.1 |
| 224 | Example | $P_2O_5$—ZnO—$R_2O$—$Al_2O_3$ | 3300 | 7 | 24 | 3.4 |

According to Table 6, in case the average crystallite size was within the above mentioned range, it was confirmed that the coercivity before and after forming the coating part did not increase as much.

DESCRIPTION OF THE REFERENCE NUMERAL

1 . . . Coated particle
2 . . . Soft magnetic metal particle
10 . . . Coating part
11 . . . First coating part
12 . . . Second coating part
13 . . . Third coating part
20 . . . Soft magnetic metal fine particle

What is claimed is:

1. A soft magnetic metal powder having coated particles, each comprising a soft magnetic metal particle including Fe, and a coating part, wherein the soft magnetic metal particle is spherical, the coating part is formed on a surface of the soft magnetic metal particle, the coating part has a first coating part, a second coating part, and a third coating part in this order from the surface of the soft magnetic metal particle towards outside, the first coating part includes an oxide of Si as a main component, the second coating part includes an oxide of Fe as a main component, the third coating part includes an oxide of at least one element selected from the group consisting of P, Si, Bi, and Zn, a soft magnetic metal fine particle exists inside the third coating part, and a thickness of the third coating part is 5 nm or more and 200 nm or less.

2. The soft magnetic metal powder according to claim 1, wherein a ratio of trivalent Fe atoms is 50% or more among Fe atoms of the oxide of Fe included in the second coating part.

3. The soft magnetic metal powder according to claim 1, wherein an aspect ratio of the soft magnetic metal fine particle is 1:2 to 1:10000.

4. The soft magnetic metal powder according to claim 2, wherein an aspect ratio of the soft magnetic metal fine particle is 1:2 to 1:10000.

5. The soft magnetic metal powder according to claim 1, wherein the soft magnetic metal particle includes a crystalline region, and an average crystallite size is 1 nm or more and 50 nm or less.

6. The soft magnetic metal powder according to claim 1, wherein the soft magnetic metal particle is amorphous.

7. A dust core constituted by the soft magnetic metal powder according to claim 1.

8. A magnetic component comprising the dust core according to claim 7.

9. The soft magnetic metal powder according to claim 1, wherein the soft magnetic metal fine particle has a short diameter direction and a long diameter direction, the short diameter direction is approximately parallel to a radial direction of the coated particle, and the long diameter direction is approximately parallel to a circumference direction of the coated particle.

10. The soft magnetic metal powder according to claim 1, wherein the oxide of the third coating part is an oxide glass.

* * * * *